US010336079B2

(12) United States Patent
Udagawa et al.

(10) Patent No.: US 10,336,079 B2
(45) Date of Patent: Jul. 2, 2019

(54) LIQUID EJECTING APPARATUS AND TUBE PUMP

(71) Applicant: SEIKO EPSON CORPORATION, Tokyo (JP)

(72) Inventors: Tomoki Udagawa, Chino (JP); Seiya Sato, Matsumoto (JP); Satoru Kobayashi, Matsumoto (JP); Ken Yamagishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/656,874

(22) Filed: Jul. 21, 2017

(65) Prior Publication Data

US 2018/0043691 A1 Feb. 15, 2018

(30) Foreign Application Priority Data

Aug. 10, 2016 (JP) ..... 2016-157660
Sep. 5, 2016 (JP) ..... 2016-172790

(51) Int. Cl.

| | |
|---|---|
| ***B41J 2/165*** | (2006.01) |
| ***B41J 2/175*** | (2006.01) |
| ***B41J 2/18*** | (2006.01) |
| ***B41J 29/02*** | (2006.01) |
| ***B41J 29/38*** | (2006.01) |

(52) U.S. Cl.

CPC ..... *B41J 2/16552* (2013.01); *B41J 2/1652* (2013.01); *B41J 2/16517* (2013.01); *B41J 2/16523* (2013.01); *B41J 2/16538* (2013.01); *B41J 2/175* (2013.01); *B41J 2/17509* (2013.01); *B41J 2/17596* (2013.01); *B41J 2/18* (2013.01); *B41J 29/02* (2013.01); *B41J 29/38* (2013.01); *B41J 2002/16555* (2013.01)

(58) Field of Classification Search

None

See application file for complete search history.

(56) References Cited

U.S. PATENT DOCUMENTS

| | | | | |
|---|---|---|---|---|
| 5,640,181 | A | 6/1997 | Uchida et al. | |
| 6,172,688 | B1 | 1/2001 | Iwasaki et al. | |
| 6,761,438 | B2 * | 7/2004 | Sato | B41J 2/17596 347/84 |
| 8,459,786 | B2 * | 6/2013 | Ito | B41J 2/17509 347/85 |
| 2011/0227998 | A1 | 9/2011 | Kamiyama | |

FOREIGN PATENT DOCUMENTS

| | | | |
|---|---|---|---|
| JP | 57-123066 | A | 7/1982 |
| JP | 03-272861 | A | 12/1991 |
| JP | 2801388 | B | 7/1998 |

(Continued)

*Primary Examiner* — Alejandro Valencia
(74) *Attorney, Agent, or Firm* — Workman Nydegger

(57) ABSTRACT

A liquid ejecting apparatus includes: a liquid ejecting unit that ejects, to a target, a liquid which is supplied from a liquid supply source via a liquid supply channel; a carriage on which the liquid ejecting unit is mounted and which moves with respect to the target; a gas containing chamber mounted on the carriage; and a pump that is disposed outside the carriage of the liquid ejecting apparatus and sends gas out to one system of a gas channel connected to the gas containing chamber and suctions gas from the gas channel.

7 Claims, 12 Drawing Sheets

(56) References Cited

FOREIGN PATENT DOCUMENTS

| | | |
|---|---|---|
| JP | 2002-307724 | 10/2002 |
| JP | 2003-276219 | 9/2003 |
| JP | 2005-288768 | 10/2005 |
| JP | 2009-226626 | 10/2009 |
| JP | 2012-144003 | 8/2012 |

* cited by examiner

LIQUID EJECTING APPARATUS AND TUBE PUMP

BACKGROUND

1. Technical Field

The present invention relates to a liquid ejecting apparatus including a carriage on which a liquid ejecting unit is mounted.

2. Related Art

As an example of a liquid ejecting apparatus, JP-A-2009-226626 discloses a printer apparatus including a carriage that is provided to be movable with respect to a target such as a sheet of paper and has a liquid ejecting unit. The printer apparatus includes a subtank mounted on a carriage, a main tank connected to the subtank, a pump, a subtank depressurizing unit that depressurizes the subtank by using a pump such that the subtank enters a negative pressure state and a subtank pressurizing unit that pressurizes the subtank such that the subtank enters a positive pressure state, and an ink transport unit that transports ink stored in the main tank to the subtank. The subtank includes, therein, a liquid supply channel (liquid storage region) as a region in which a liquid is stored and a gas containing chamber (gas containing region) as a region in which gas is contained. Suction of gas by the pump causes the gas containing chamber in the subtank to be depressurized and enter the negative pressure state, and the ink is transported from the main tank to the subtank. In addition, pressurization of the gas containing chamber with the gas sent out from the pump causes the subtank to be pressurized to have positive pressure, and cleaning is performed in such a way that a liquid flows out from the liquid ejecting unit.

The liquid ejecting apparatus disclosed in JP-A-2009-226626 needs to include two systems of gas channels of a gas channel for depressurization that connects the pump and the carriage such that the gas containing chamber in the subtank mounted on the carriage is depressurized and a gas channel for pressurization that connects the pump and the carriage such that the gas containing chamber pressurized. Therefore, a problem arises in that a pressure regulating mechanism has a complex configuration including the pump, the subtank depressurizing unit, the subtank pressurizing unit, and the like which are provided to pressurize and depressurize the gas containing chamber in the subtank on the carriage. The above problem is common not only in a case where one gas containing chamber is mounted on the carriage, but also in a case where a configuration includes at least one depressurization chamber and at least one pressurization chamber because the pump and the carriage need to be connected to each other by two systems of gas channels for depressurization and pressurization.

SUMMARY

An advantage of some aspects of the invention is to provide a liquid ejecting apparatus that can include a pressure regulating mechanism configured to pressurize and depressurize a gas containing chamber mounted on a carriage.

In addition, another advantage thereof is to provide a liquid ejecting apparatus and a pump that is capable of pumping a fluid.

According to an aspect of the invention, there is provided a liquid ejecting apparatus including: a liquid ejecting unit that ejects, to a target, a liquid which is supplied from a liquid supply source via a liquid supply channel; a carriage on which the liquid ejecting unit is mounted and which moves with respect to the target; a gas containing chamber mounted on the carriage; and a pump that is disposed outside the carriage of the liquid ejecting apparatus and sends gas out to one system of a gas channel connected to the gas containing chamber and suctions gas from the gas channel.

In this configuration, since the pump that is capable of sending the gas out and suctioning the gas is connected to the gas containing chamber mounted on the carriage by the one system of the gas channel, it is possible to reduce the size of the pressure regulating mechanism that includes the pump, the gas channel, and the gas containing chamber.

In the liquid ejecting apparatus, it is preferable that the gas containing chamber include a depressurization chamber that is provided at a position adjacent to the liquid supply channel and is depressurized and a pressurization chamber that presses the liquid supply channel and discharges the liquid from the liquid ejecting unit.

In this configuration, the gas containing chamber includes the depressurization chamber and the pressurization chamber. Therefore, degassing or defoaming of the liquid in the liquid supply channel and the discharge of the liquid from the liquid ejecting unit through the pressing of the liquid supply channel are performed, and thereby it is possible to easily and still more normally maintain a ejecting state of a liquid from the liquid ejecting unit.

In the liquid ejecting apparatus, it is preferable that the gas channel be connected, at a connection position, to an on-carriage gas channel that connects the depressurization chamber and the pressurization chamber. It is preferable that a one-way valve be provided to be closer to the depressurization chamber than to the connection position of the on-carriage gas channel, and allow gas to flow in a direction such that the depressurization chamber is depressurized and restrict the gas from flowing in a direction such that the depressurization chamber is pressurized. It is preferable that a pressing portion that presses the liquid supply channel of the pressurization chamber be formed by a flexible member.

In this configuration, switching is performed between pressurization drive by which the pump sends the gas out and depressurization drive by which the pump suctions the gas, and thereby it is possible to easily realize depressurization of the depressurization chamber and pressurization of the pressurization chamber through the one system of the gas channel. In addition, even the pump is subjected to switching from the depressurization drive to the pressurization drive, it is possible to maintain a depressurized state in the depressurization chamber.

In the liquid ejecting apparatus, it is preferable that the liquid supply channel and the gas channel be integrally made of a flexible material.

In this configuration, it is possible to reduce the size of the flexible channel that connects an apparatus main body and the carriage.

In the liquid ejecting apparatus, it is preferable that the pump be a tube pump including a frame that supports a tube having a channel therein, a rotary body that is rotatable around a shaft center by power from a drive source, and a press roller that is supported by the rotary body and rotates around the shaft center so as to press the tube. It is preferable that the rotary body include a guide portion that extends in the rotating direction of the rotary body and has a blocking position at which the channel of the tube is blocked by the press roller and a canceling position at which blocking of the channel is canceled. It is preferable that the channel be blocked by rotation of the rotary body in one direction, the blocking of the channel be canceled by rotation of the rotary body in the other direction from a state in which the channel is blocked, and then the channel be blocked. It is preferable that one end of the tube be connected to the gas channel, gas be suctioned from the one end of the tube by the rotation of the rotary body in the one direction, and gas be sent out from the one end of the tube by the rotation of the rotary body in the other direction.

It is possible to suitably employ this configuration as a configuration of a pressure regulating pump.

According to another aspect of the invention, there is provided a tube pump that is provided at a position on a tube having a hollow portion which forms a channel, the tube pump including: a frame that accommodates the tube in a state in which the tube is curved into a ring shape; a rotary body that rotates around a rotary shaft positioned on an inner circumference side of a ring of the tube by power of a drive source in a first rotating direction and a second rotating direction which is an opposite direction to the first rotating direction; and a press roller that is locked to the rotary body that performs rotation and thus revolves while pressing the tube. The rotary body includes a first locking portion that locks the press roller during the rotation in the first rotating direction, a second locking portion that locks the press roller during the rotation in the second rotating direction, a first curved guide portion that is curved into a helical shape as the first curved guide portion is closer to the rotary shaft from the first locking portion, and a second curved guide portion that is curved into a helical shape as the second curved guide portion is closer to the rotary shaft from the second locking portion. The press roller engages with the first curved guide portion and the second curved guide portion and the pressing of the tube is canceled when the rotating direction of the rotary body is reversed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with reference to the figures. For example, the liquid ejecting apparatus is an ink jet type printer that ejects ink as an example of a liquid to a medium such as a sheet of paper as an example of a target, thereby performing recording (printing).

Embodiment of Liquid Ejecting Apparatus

Figure 1:
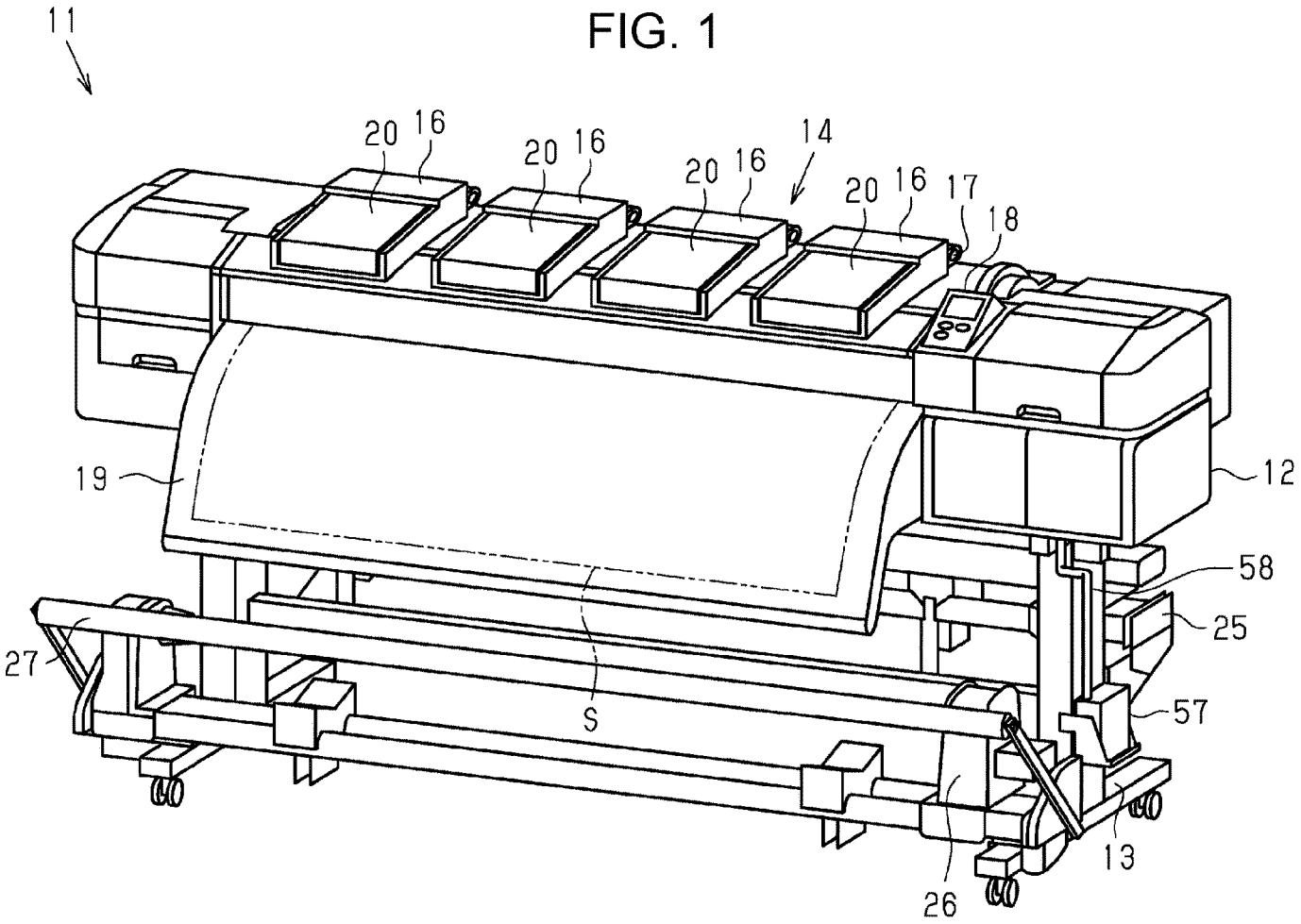
FIG. 1 is a perspective view illustrating an embodiment of a liquid ejecting apparatus.

As illustrated in FIG. 1, a liquid ejecting apparatus 11 of the embodiment is a large format printer (LFP) that performs printing on a medium S such as an A0 size or a B0 size in the JIS which have a relatively large size.

The liquid ejecting apparatus 11 includes a housing 12, a support leg 13 that supports the housing 12, and a liquid supply device 14 that is disposed on the housing 12. The liquid supply device 14 includes one or a plurality of (four in the embodiment) container holder 16 in which it is possible to install a liquid container 20 as an example of a liquid supply source that contains a liquid and a rotary shaft 17 provided on a proximal end side of the container holder 16. The container holder 16 holds the installed liquid container 20.

When a front side means a side of the housing 12 on which the medium S, on which printing has been performed, is discharged, an operating unit 18 on which operation of the liquid ejecting apparatus 11 is performed, is provided on the front side of the housing 12. In addition, a support overhang 19 overhangs a portion of the housing 12 on the front side and supports and guides, downward, the medium S, on which printing has been performed.

Figure 2:
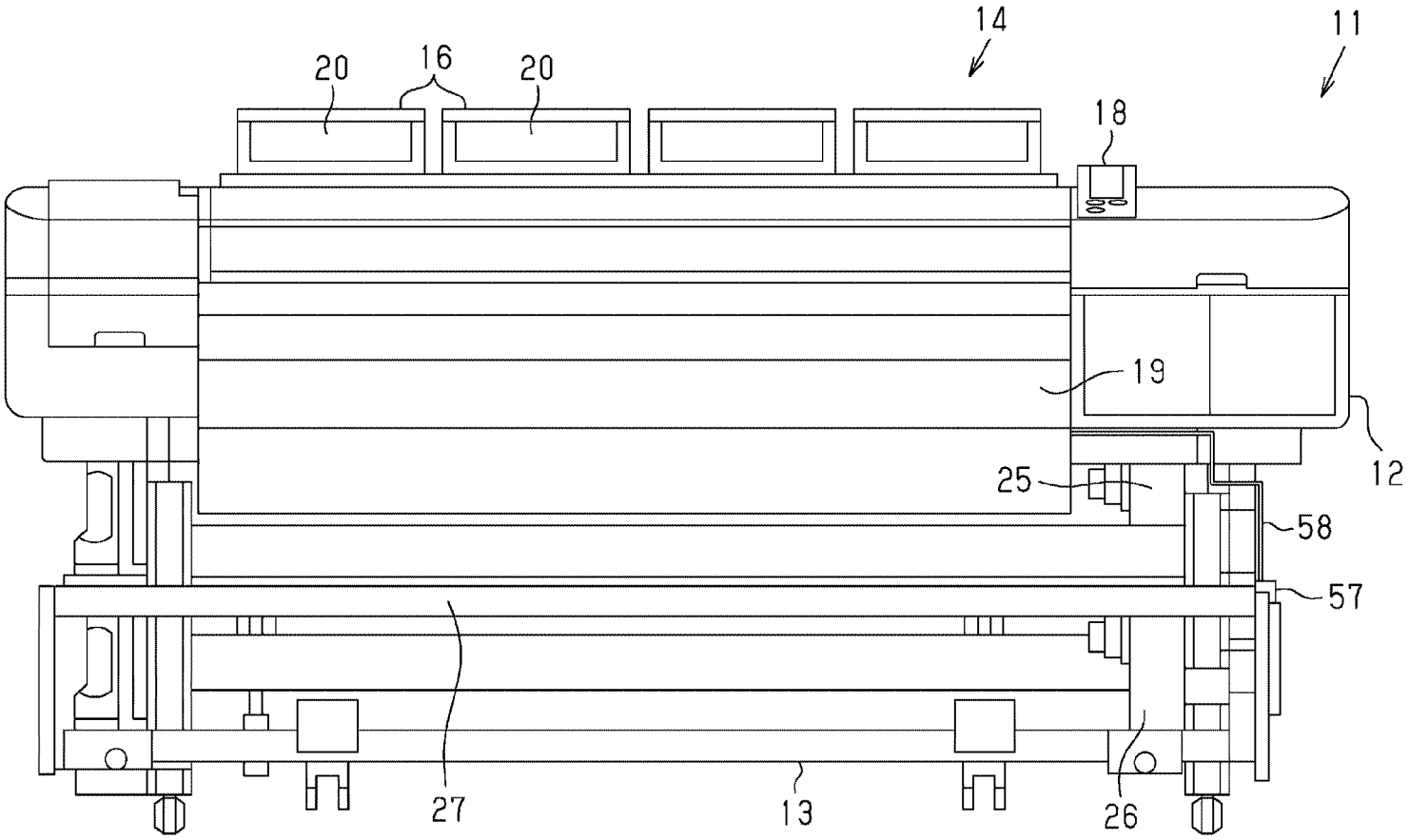
FIG. 2 is a front view illustrating the liquid ejecting apparatus.

As illustrated in FIG. 2, the housing 12 is divided, in a longitudinal direction (horizontal direction in FIG. 2) into a central portion such as the support overhang 19 in which a transport path of the medium S is disposed and both end portions of outer sides of the transport path. It is preferable that the liquid supply device 14 be disposed in the central portion in the longitudinal direction in which the transport path of the medium S is disposed.

In a case where a plurality of container holders 16 are provided, the plurality of container holders 16 may be disposed side by side in the longitudinal direction of the housing 12. The liquid container 20 is attached to and detached from the container holder 16 when the container holder 16 is placed at an attachment and detachment position illustrated in FIG. 2. Therefore, it is preferable that the container holder 16 have a flat posture having a width and a depth which are longer than the height of the liquid container 20, at the attachment and detachment position. The flat posture enables the height of a large-sized liquid container 20 to be reduced and to be subjected to a stable attachment and detachment operation. In addition, when the liquid container 20 horizontally moves so as to be attached to and detached from the container holder 16, the weight of the liquid container 20 does not have an influence on the attachment and detachment operation.

Figure 3:
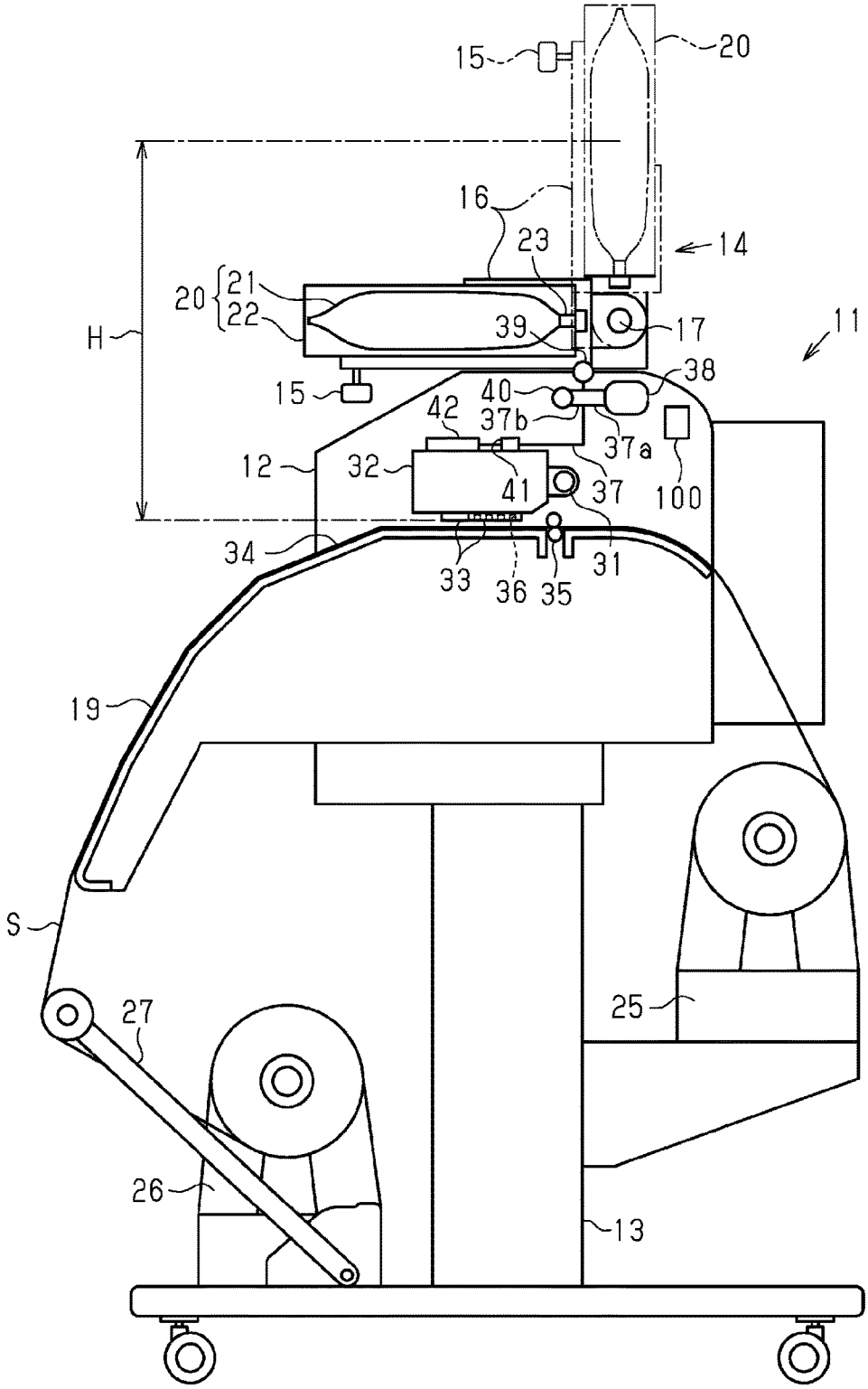
FIG. 3 is a schematic side view illustrating an entire configuration of the liquid ejecting apparatus.

As illustrated in FIG. 3, the liquid ejecting apparatus 11 may include a feeding mechanism 25 that rotatably holds the medium S (for example, roll paper) wound into a cylindrical shape before use, a winding mechanism 26 by which the medium S, on which printing has been performed, is discharged from the housing 12 and is wound, and a tension bar 27 that applies tension to the medium S discharged from the housing 12. In the configuration, it is possible to continuously perform a recording process on a long medium S wound into the cylindrical shape.

A carriage 32 is provided in the housing 12, has a liquid ejecting unit 33 mounted thereon, and moves with respect to the medium S. Specifically, the housing 12 accommodates a guide shaft 31 extending in the longitudinal direction, the carriage 32 that reciprocates along the guide shaft 31, one or the plurality of (two in the embodiment) liquid ejecting units 33 (also refer to FIG. 4) held by the carriage 32, a support 34 that forms the transport path of the medium S in the housing 12, and a transport mechanism 35 that transports the medium S in the housing 12.

The liquid ejecting unit 33 is provided with a plurality of nozzles 36 and perform the recording process by ejecting liquids from the nozzles 36 toward the medium S that is transported over the support 34 by the transport mechanism 35. In the embodiment, the moving direction of the carriage 32 is coincident with the longitudinal direction of the housing 12. In addition, the transport path of the medium S on the support 34 intersects with (preferably, is orthogonal to) the moving direction of the carriage 32.

A liquid supply channel 37 is connected to the carriage 32 and causes a liquid contained in the liquid container 20 to flow toward the liquid ejecting unit 33. The container holder 16 is disposed at a position at which it is possible to supply the liquid to the liquid ejecting unit 33 due to a water head generated by a height difference between the nozzles 36 and the liquid contained in the installed liquid container 20. Note that the "water head" is obtained by converting pressure of a liquid into a height of a liquid column in the direction of gravitational force and has a dimension of length (for example, m). For example, in a case where a liquid is water and a water head of 1 m is converted into pressure, the pressure is 9.8 kPa.

The container holder 16 is provided to be movable between the attachment and detachment position represented by a solid line in FIG. 3 and a supply position represented by a two-dot chain line in FIG. 3. In the embodiment, the container holder 16 rotates around a rotary shaft 17 by about 90 degrees, thereby moving between the supply position and the attachment and detachment position. In a case where the plurality of the container holders 16 are provided, the plurality of container holders 16 may be configured to individually rotate or the plurality of container holders 16 may all be configured to rotate together.

The container holder 16 can be configured to rotate around the rotary shaft 17 by power of a drive source (not illustrated) or can be configured to manually rotate. For example, the drive source for causing the container holder 16 to rotate may also serve as a motor provided for unwinding an unused medium S wound into a cylindrical shape, or winding the medium S, on which printing has been performed. In a case where the container holder 16 manually rotates, the container holder 16 may be provided with a handle 15.

An inclined posture of the liquid container 20 with respect to the horizontal direction with a rotation angle of 90 degrees or smaller may be the attachment and detachment position or the supply position of the container holder 16. In any case, when a value is obtained by converting the water head generated by the height difference between the nozzles 36 and the liquid contained in the installed liquid container 20 at the supply position into the pressure, it is preferable that the value be larger than a loss in pressure which occurs when the liquid is ejected for the recording process.

At the supply position, it is preferable that the liquid container 20 installed in the container holder 16 have a vertical posture having a height longer than that at the attachment and detachment position. In addition, at the attachment and detachment position, it is preferable that the position of the installed liquid container 20 be lower than the supply position.

For example, the liquid container 20 may be a cartridge including a liquid containing portion 21 formed by a bag having flexibility and a case 22 that accommodates the liquid containing portion 21, or may be a tank that directly contains the liquid. In addition, an example in which the liquid containing portion 21 formed by the bag having the flexibility as the liquid container 20 may set on a tray that is attachable to and detachable from the container holder 16 and the liquid containing portion 21 is installed on the container holder 16 with the tray may be employed. The liquid containing portion 21 is provided with a leading-out portion 23 which is an outlet of the contained liquid, and the liquid containing portion 21 is connected to an upstream end of the liquid supply channel 37 when being installed in the container holder 16 such that the liquid can be supplied through the leading-out portion 23. When the leading-out portion 23 is disposed under the liquid containing portion 21 at the supply position, the liquid is likely to flow out from the liquid containing portion 21 by the water head.

The liquid ejecting apparatus 11 includes a pumping mechanism 38 that causes the liquid to forcibly flow from the liquid container 20 to the liquid ejecting unit 33, and a control unit 100 that controls various types of mechanisms provided in the liquid ejecting apparatus 11. It is preferable that the pressure applied to the liquid by the pumping mechanism 38 be larger than a value obtained by converting the water head into the pressure at the supply position. The control unit 100 controls drive of the pumping mechanism 38 at a predetermined timing, thereby switching between supply of the liquid by the water head and the supply of the liquid by the pumping mechanism 38.

In the liquid container 20, in a case where the liquid containing portion 21 formed by a closed bag contains (is filled with) the liquid, the contained liquid has a "water head center". The "water head center" corresponds to a liquid level of the liquid contained in a so-called open-type liquid containing portion of which an internal space opens to the atmosphere. A water head (potential energy of the liquid) with respect to the nozzles 36 which are generated by the liquid contained in the liquid containing portion 21 disposed at the supply position is defined by the height difference of the "water head center" and the nozzles 36.

Similar to the liquid level that is contained in the open type liquid containing portion, when a remaining amount of the liquid contained in the liquid containing portion 21 is reduced, the "water head center" moves downward in the direction of gravitational force. The liquid containing portion 21 in an unused state in the embodiment is filled with a liquid such that the "water head center" has a height which is half the height of the liquid containing portion 21 disposed at the supply position, and the maximum value of the water head corresponds to a height difference H in FIG. 3.

The liquid supply channel 37 may be bifurcated into two bifurcated channels 37*a* and 37*b* which are connected to the container holder 16 on the upstream side. In this case, the pumping mechanism 38 may be provided on one bifurcated channel 37*a*, and a one-way valve 40 may be provided to the other bifurcated channel 37*b*. The one-way valve 40 allows the liquid to flow downstream and restricts the liquid from flowing upstream.

An on-off valve 39 is provided at a position upstream from the bifurcated channels 37*a* and 37*b* on the liquid supply channel 37. The on-off valve 39 allows the liquid to flow in an opened state, and restricts the liquid from flowing in a closed state. It is preferable that the on-off valve 39 be configured to be switched between the opened state and the closed state through opening and closing control by the control unit 100.

Figure 4:
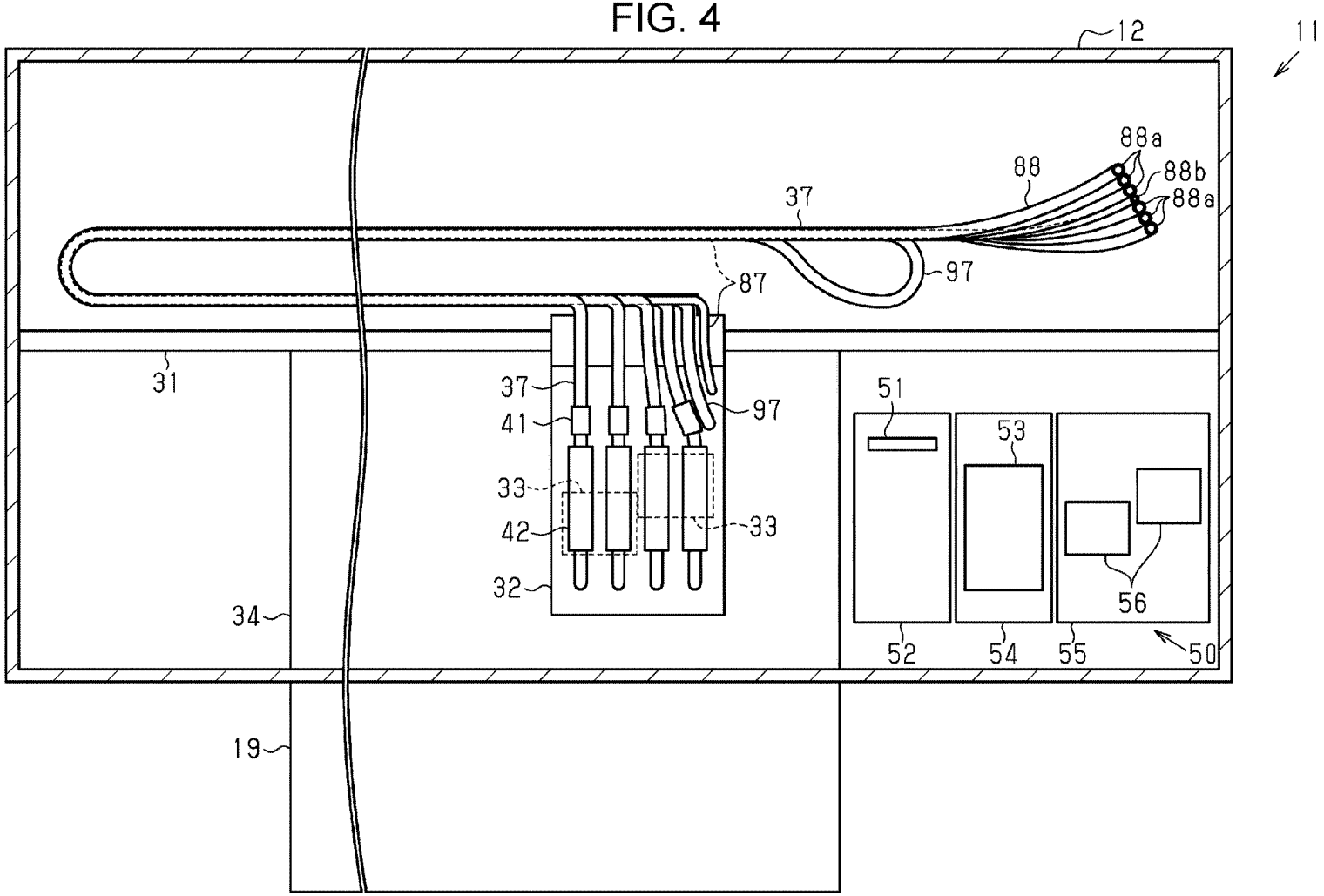
FIG. 4 is a schematic sectional view illustrating a configuration of the liquid ejecting apparatus.

As illustrated in FIG. 4, the liquid supply channel 37 is laid around such that an extending direction is reversed at an end portion of the longitudinal direction in the housing 12, and the downstream side of the liquid supply channel is connected to the carriage 32.

It is preferable that the liquid supply channel 37 is provided with a filter unit 41 that is mounted on the carriage 32 and captures foreign matter such as bubbles mixed into the liquid. When the filter unit 41 is exposed on the outer side of the carriage 32, it is possible to easily perform maintenance such as replacement. For example, when the liquid supply channel 37 is provided with a static mixer 42 (also refer to FIG. 5) that causes a change such as a change in direction or division in the flow of the liquid, on the downstream side of the filter unit 41, it is possible to reduce unbalanced concentration in the liquid.

When the right end side in FIG. 4 is a starting end of outward movement of the carriage 32, a maintenance mechanism 50 provided to perform maintenance of the liquid ejecting unit 33 is disposed in a right-side portion in the housing 12 which is the outer side of the transport path. The maintenance mechanism 50 includes a wiping device 52 provided with a wiping member 51 that wipes the liquid ejecting unit 33, a flushing unit 54 provided with a liquid receiving portion 53 that receives a liquid that is ejected by the liquid ejecting unit 33, and a cleaning mechanism 55 that cleans the liquid ejecting unit 33. The wiping device 52, the flushing unit 54, and the cleaning mechanism 55 are disposed side by side with the support 34 in the longitudinal direction.

The wiping device 52 causes the wiping member 51 to relatively move with respect to the liquid ejecting unit 33, thereby wiping the liquid ejecting unit 33. The flushing unit 54 is provided to aim at prevention or removing of clogging of the nozzles 36 and, when flushing is performed and droplets are spouted out from the nozzles 36, the liquid receiving portion 53 receives the spouted liquid. For example, the liquid receiving portion 53 can be configured of a rotating endless belt.

Figure 5:
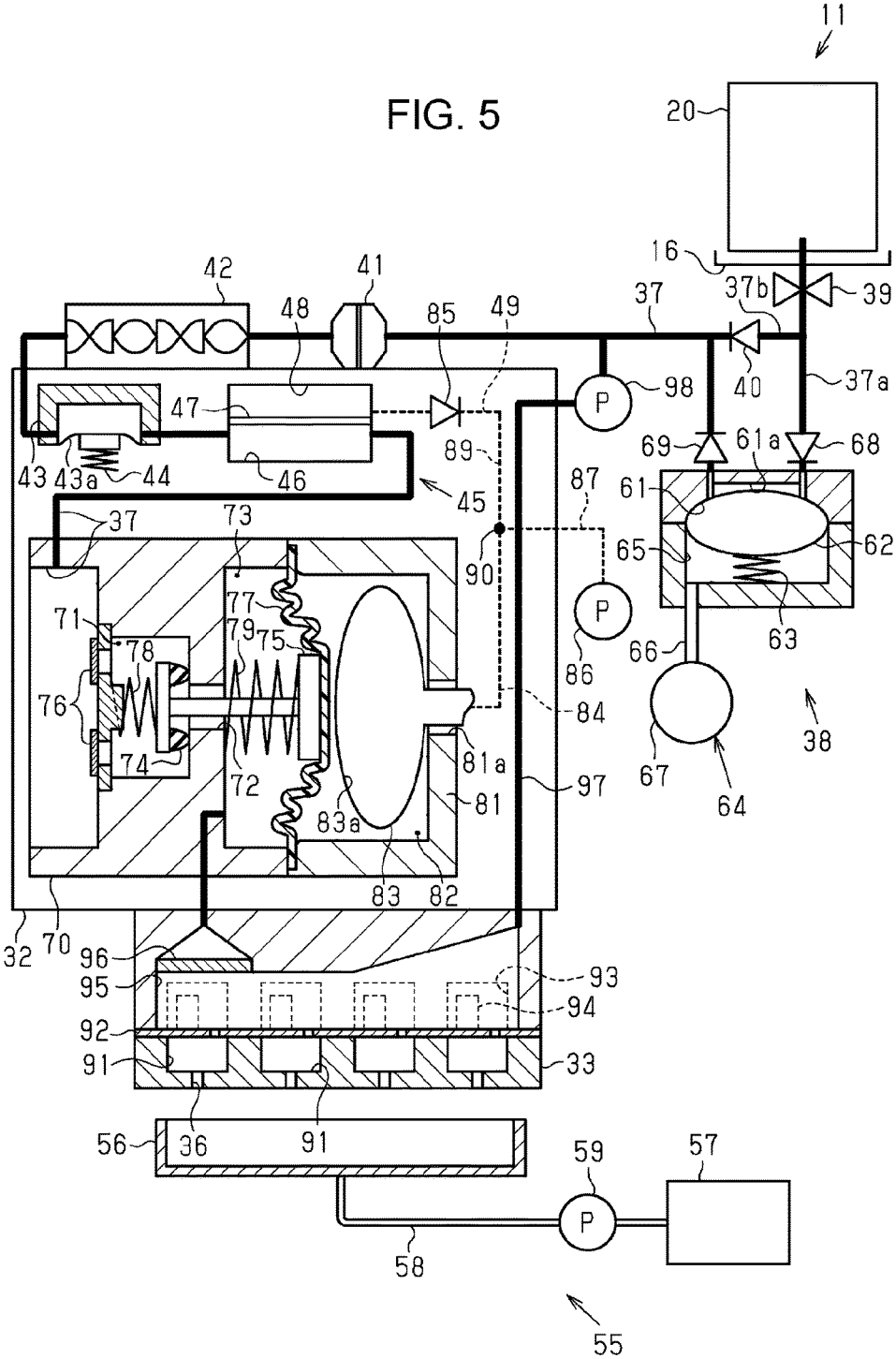
FIG. 5 is a schematic diagram illustrating a liquid supply system and a pressure regulating mechanism in the liquid ejecting apparatus.

As illustrated in FIG. 5, the cleaning mechanism 55 includes a cap 56 that forms a closed space, in which the nozzles 36 are opened, between the cap and the liquid ejecting unit 33, a waste liquid container 57 that contains a waste liquid, a suction channel 58 that connects the cap 56 and the waste liquid container 57, and a suction pump 59 provided on the suction channel 58. The waste liquid container 57 may not be disposed outside the housing 12 (refer to FIG. 1).

The suction pump 59 is driven in a state in which the cap 56 forms the closed space, and thereby the closed space has the negative pressure and the cleaning mechanism 55 performs suction cleaning by discharging the liquid from the nozzles 36. Through the suction cleaning, foreign matter such as bubbles in the liquid ejecting unit 33 is discharged along with the liquid. The liquid discharged from the nozzles 36 is contained as the waste liquid into the waste liquid container 57 through the suction channel 58.

A liquid storage portion 43, a degassing mechanism 45, and a pressure regulating mechanism 70 are mounted in this order on the carriage 32 to which the liquid supply channel 37 is connected, from the upstream side to the downstream side of the liquid supply channel 37. The carriage 32 is provided with a depressurization chamber 48 used for depressurization of the liquid and a pressurization chamber 83*a* used for pressurization of the liquid, as an example of a gas containing chamber disposed at a position adjacent to the liquid supply channel 37 such that the pressure is applied to or is reduced in a liquid in a predetermined channel of a channel portion (a liquid supply channel on the carriage) of the liquid supply channel 37 which is provided in the carriage 32.

A part of a wall surface of the liquid storage portion 43 is configured to include a flexible member 43*a* that can be bent and deformed, and thus the liquid storage portion forms a space having a variable volume. The liquid storage portion 43 stores a liquid in a space having the variable volume that is pressurized by bias force of a spring 44 and reduce pressure fluctuation of the liquid.

The degassing mechanism 45 includes a degassing chamber 46 that temporarily stores a liquid, the depressurization chamber 48 that is divided by a degassing membrane 47 from the degassing chamber 46 and is depressurized, a depressurization channel 49 that is connected to the depressurization chamber 48, and a pump 86. The degassing membrane 47 has properties of causing gases to pass therethrough but preventing a liquid from passing therethrough. The drive of the pump 86 depressurizes the depressurization chamber 48 through the depressurization channel 49, and thereby bubbles or dissolved gases mixed in the liquid stored in the degassing chamber 46 are removed. The depressurization chamber 48 is disposed at a position adjacent to the degassing chamber 46 via the degassing membrane 47, and the degassing chamber is a part of the liquid supply channel 37.

The pressure regulating mechanism 70 includes a supply chamber 71 that is provided at a position on the liquid supply channel 37, a pressure chamber 73 that can communicate with the supply chamber 71 via a communication hole 72, a valve body 74 that can open and close the communication hole 72, and a pressure receiving member 75 having a proximal end side that is accommodated in the supply chamber 71 and a distal end side that is accommodated in the pressure chamber 73. For example, the valve body 74 is formed of an elastic body attached to a proximal portion of the pressure receiving member 75 that is positioned in the supply chamber 71. The liquid supply channel 37 may be provided with a filter 76 that filters a liquid that flows into the supply chamber 71.

A part of a wall surface of the pressure chamber 73 is formed by a flexible membrane 77 that can be bent and deformed. In addition, the pressure regulating mechanism 70 includes a first bias member 78 that is accommodated in the supply chamber 71 and a second bias member 79 that is accommodated in the pressure chamber 73. The first bias member 78 biases, via the pressure receiving member 75, the valve body 74 in a direction in which the communication hole 72 is blocked.

The flexible membrane 77 is bent and deformed and push the pressure chamber in a direction in which the volume of the pressure chamber 73 decreases, and thereby the pressure receiving member 75 is displaced. The state of the valve body 74 is switched from the closed state to the opened state when a pressure (internal pressure) which is applied to a surface of the flexible membrane 77 on an inner side as the pressure chamber 73 side is lower than a pressure (external pressure) which is applied to a surface of the flexible membrane 77 on an outer side as an opposite side to the pressure chamber 73, and a difference between the pressure applied to the surface on the inner side and the pressure applied to the surface on the outer side is equal to or larger than a predetermined value (for example, 1 kPa).

Note that the predetermined value is a value determined depending on the bias force of the first bias member 78 and the second bias member 79, force required to displace the flexible membrane 77, pressing force (seal load) required to block the communication hole 72 by the valve body 74, and the pressure in the supply chamber 71 and the pressure in the pressure chamber 73 which act on a front surface of the pressure receiving member 75 on the supply chamber 71 side and a front surface of the valve body 74.

In other words, the more the bias force of the first bias member 78 and the second bias member 79 increases, the larger the predetermined value. In addition, the bias force of the first bias member 78 and the second bias member 79 is set such that the pressure in the pressure chamber 73 is in the negative pressure state (−1 kPa, for example, in a case where the pressure applied to the surface of the flexible membrane 77 on the outer side is the atmospheric pressure) in a range in which a meniscus is formed on a gas-liquid interface in the nozzle 36.

When the communication hole 72 is opened and a liquid flows from the supply chamber 71 into the pressure chamber 73, the internal pressure of the pressure chamber 73 increases. When the internal pressure of the pressure chamber 73 reaches the predetermined value described above, the valve body 74 blocks the communication hole 72.

The internal pressure of the pressure chamber 73 is reduced in response to discharge of a liquid from the liquid ejecting unit 33. The valve body 74 autonomously opens and closes the communication hole 72 in response to a differential pressure between the external pressure (atmospheric pressure) of the pressure chamber 73 and the internal pressure of the pressure chamber 73. Therefore, the pressure regulating mechanism 70 is classified into a differential pressure regulating valve (particularly, to a pressure reducing valve of the differential pressure regulating valves).

The pressure regulating mechanism 70 may further include a valve opening mechanism 81 that forcibly opens the communication hole 72 and supplies a liquid to the liquid ejecting unit 33. For example, the valve opening mechanism 81 includes a pressurization bag 83 accommodated in an accommodation chamber 82 that is divided from the pressure chamber 73 by the flexible membrane 77. The pressurization bag 83 is formed by a flexible member and is provided with the pressurization chamber 83*a* as an example of a gas containing chamber inside the pressurization bag. The pressurization chamber 83*a* of the pressurization bag 83 is connected to a pressurization channel 84 via a through-hole 81*a* provided in the accommodation chamber 82. The accommodation chamber 82 is opened to an outside space (atmosphere) through a gap between the through-hole 81*a* and the pressurization channel 84, and the pressurization bag 83 is inflated with gases supplied to the pressurization chamber 83*a* through the pressurization channel 84, thereby functioning as a pressing portion that presses the pressure chamber 73 which is a part of the liquid supply channel 37. The pressing of the inflated pressurization bag 83 causes the flexible membrane 77 to be bent and displaced in a direction in which the volume of the pressure chamber 73 decreases, and thereby the communication hole 72 is forcibly opened. The forcible open of the communication hole 72 by the valve opening mechanism 81 enables pressurization cleaning to be performed by causing a liquid pressurized from the liquid ejecting unit 33 to flow out (to be discharged). Note that the pressurization chamber 83*a* is disposed at a position adjacent to the pressure chamber 73 via the flexible membrane 77, and the pressure chamber is a part of the liquid supply channel 37.

A gas channel 87 is connected, at a connection position 90, to an on-carriage gas channel 89 that connects the depressurization chamber 48 and the pressurization chamber 83*a*. The on-carriage gas channel 89 includes the depressurization channel 49 on the depressurization chamber 48 side from the connection position 90, and the pressurization channel 84 on the pressurization chamber 83*a* side from the connection position 90. In other words, the gas channel 87 extending from the pump 86 is connected to the carriage 32 and is bifurcated into the pressurization channel 84 and the depressurization channel 49 at the connection position 90 on the carriage 32. A one-way valve 85 is provided to be closer to the depressurization channel 49, which is a channel portion, on the depressurization chamber 48 side than to the connection position 90 of the on-carriage gas channel 89, and allows gas to flow in a direction such that the depressurization chamber 48 is depressurized and restricts the gas from flowing in a direction such that the depressurization chamber 48 is pressurized.

The pump 86 is disposed at a position out of the carriage 32 in the housing 12 of the liquid ejecting apparatus 11. The pump 86 is configured to be capable of sending gas out to one system of the gas channel 87 connected to the depressurization chamber 48 and the pressurization chamber 83*a* and suctioning the gas from the gas channel 87. In other words, the pump 86 is configured to be capable of driving for both of the pressurization and depressurization, and is capable of performing pressurization drive for sending the gas out to the pressurization bag 83 and depressurization drive for suctioning the gas from the depressurization chamber 48. The pressurization drive by the pump 86 causes the gas to be sent out to the pressurization bag 83 and the depressurization drive by the pump 86 depressurizes the depressurization chamber 48.

The fact that the gas channel 87 is formed of the one system indicates that the gas that is sent out and is suctioned by one pump has one type of flow. Therefore, as long as the gas has one type of flow, a single or a plurality of channels may be provided. The gas channel 87 functions as a pressurization channel along with the pressurization channel 84 when the pump 86 performs the pressurization drive. The depressurization channel 49 functions as a depressurization channel along with the depressurization channel 49 when the pump 86 performs the depressurization drive. Accordingly, the entire channel including the gas channel 87 (common channel) and the pressurization channel 84 and the depressurization channel 49 which are connected to each other at the connection position 90 are the gas channel in a broad definition.

The liquid ejecting unit 33 includes a liquid chamber 91 that communicates with the nozzle 36, an accommodation portion 93 divided from the liquid chamber 91 by a vibration plate 92, an actuator 94 accommodated in the accommodation portion 93, and a common liquid chamber 95 that temporarily stores a liquid flowing out from the pressure chamber 73 and supplies the liquid to a plurality of liquid chambers 91. A filter 96 that filters the liquid may be disposed between the pressure chamber 73 and the common liquid chamber 95.

For example, the actuator 94 is a piezoelectric element that is contracted in a case where a drive voltage is applied. When the vibration plate 92 is deformed in response to the contraction of the actuator 94, and then the application of the drive voltage is canceled, the liquid in the liquid chamber 91, whose volume is changed, is ejected as droplets from the nozzles 36.

At this time, when bubbles are mixed in the nozzle 36, the droplets are not properly ejected and defective ejection is performed. In addition, in a case where the nozzle 36 is clogged with foreign matter such as solid matter, or in a case where the viscosity of the liquid increases due to drying or the like, defective ejection is also performed. In order to prevent such defective ejection, it is preferable that the filter unit 41 or the filters 76 and 96 be provided in the liquid supply channel 37 so as to remove the foreign matter such as bubbles.

A return channel 97, through which a liquid returns to the liquid supply channel 37 between the filter unit 41 and the on-off valve 39, is connected to the common liquid chamber 95, and a circulation pump 98 that causes a liquid to flow from the common liquid chamber 95 to the return channel 97 may be disposed on the return channel 97. In the configuration, driving of the circulation pump 98 causes the liquid to circulate between the return channel 97 and the liquid supply channel 37, and thereby it is possible to capture foreign matter such as bubbles with the filter unit 41 and the filters 76 and 96 in the liquid supply channel 37. In addition, in a case where the liquid contains sedimentation components such as pigments, the liquid is circulated or passes through the static mixer 42, and thereby the liquid is stirred such that it is possible to have balanced concentration.

As illustrated in FIG. 4, the liquid supply channel 37 and the gas channel 87 are integrally made of a flexible material. In the example, the liquid supply channel 37, the return channel 97, and the gas channel 87 have a portion extending between the apparatus main body and the carriage 32, which is integrally formed by a flexible material into one flat bundle. As an example, multiple tubes 88, which are connected to adjacent tubes in a state in which a plurality of (many) tubes are arranged side by side in a line and thereby integrally form a flat plate shape, is used. In FIG. 4, some of the multiple tubes 88 are cut and sectional planes of the tubes are drawn to be shown. As illustrated in FIG. 4, as an example, the multiple tubes 88 is in a state in which at least one (one in the example of FIG. 4) tube 88*b* having a small diameter (second channel diameter) is sandwiched between groups of a plurality of tubes 88*a* having a large diameter (first channel diameter). The tube 88*a* having the large diameter is used as the liquid supply channel 37, and the tube 88*b* having the small diameter is used as the gas channel 87. In the example, (N−1) tubes of N (here, N is a natural number equal to or larger than 4) tubes 88*a* having the large diameter are used as the liquid supply channels 37, and one remaining tube 88*a* having the large diameter is used as the return channel 97, and the tube 88*b* having the small diameter is used as the gas channel 87. The one system of the gas channel 87 that connects the pump 86 and the carriage 32 is formed by one tube 88*b*. Here, the gas channel 87 is formed by the tube 88*b* having the second channel diameter smaller than the first channel diameter of the tube 88*a* of the liquid supply channel 37 such that a period of time taken for the depressurization and a period of time taken for the pressurization from starting of the drive of the pump 86 are shortened. Note that the channel diameter of the gas channel 87 may be set to an appropriate value, and may be the same diameter as that of the liquid supply channel 37 or a diameter larger than that of the liquid supply channel 37.

Next, an example of a configuration of the pumping mechanism 38 will be described.

The pumping mechanism 38 is, for example, a diaphragm pump, and includes a pump chamber 61 that is provided at a position on the bifurcated channel 37*a* that configures the liquid supply channel 37, a displacement member 62 that configures a part of a wall surface of the pump chamber 61, a spring 63 that is disposed on the outer side of the pump chamber 61, and a displacement mechanism 64. The displacement member 62 is displaced in a direction in which the volume of the pump chamber 61 increases. The spring 63 biases the displacement member 62 in a direction in which the volume of the pump chamber 61 decreases. However, it is preferable that a part of the wall surface of the pump chamber 61 be provided with a communication groove 61*a* such that a liquid flows even in a state in which the pump chamber 61 has the minimum volume due to the bias force of the spring 63.

The displacement mechanism 64 includes a gas chamber 65 divided from the pump chamber 61 by the displacement member 62 and a gas suctioning pump 67 that suctions gases from the gas chamber 65 through an aeration path 66. The driving of the gas suctioning pump 67 enables the displacement mechanism to resist the bias force of the spring 63 such that the displacement member 62 is displaced in the direction in which the volume of the pump chamber 61 increases. Note that, when the driving of the gas suctioning pump 67 is stopped, a configuration, in which gas flows into the gas chamber 65 through the aeration path 66, and the displacement member 62 is displaced due to the bias force of the spring 63 in the direction in which the volume of the pump chamber 61 decreases, may be employed.

In addition, the pumping mechanism 38 includes a suction valve 68 that is provided between the container holder 16 and the pump chamber 61, and a discharge valve 69 that is provided between the pump chamber 61 and the liquid ejecting unit 33. The suction valve 68 is a one-way valve that allows a liquid to flow into the pump chamber 61 and that restricts the liquid from flowing out from the pump chamber 61. The discharge valve 69 is a one-way valve that allows a liquid to flow out from the pump chamber 61 and that restricts the liquid from flowing into the pump chamber 61. The gas suctioning pump 67 is driven, and thereby the suction drive is performed such that the liquid flows into the pump chamber 61. The driving of the gas suctioning pump 67 is stopped, and thereby the discharge drive is performed such that the liquid flows out from the pump chamber 61 due to the bias force of the spring 63.

First Embodiment of Tube Pump

Subsequently, a first embodiment of the tube pump will be described with reference to the figures.

Figure 6:
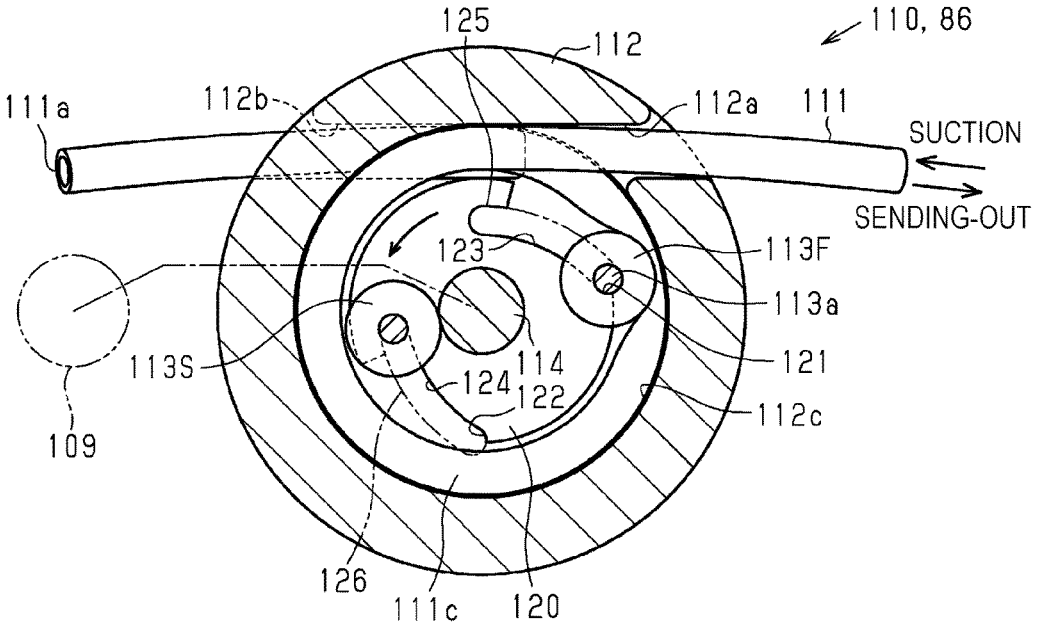
FIG. 6 is a sectional view illustrating a first embodiment of a tube pump.

As illustrated in FIG. 6, a tube pump 110 of the embodiment is a tube pump that is provided at a position on a tube 111 having a hollow portion 111*a* that forms a channel, and, for example, can be used as the pump 86 or the suction pump 59 of the liquid ejecting apparatus 11 illustrated in FIG. 5.

The tube pump 110 includes a frame 112 having a cylindrical inner circumferential surface 112*c* and accommodates the tube 111 having a state of being curved into a ring shape along the inner circumferential surface 112*c*. In addition, the tube pump 110 includes a rotary body 120 that has a rotary shaft 114 and is disposed on an inner circumference side of a ring 111*c* of the tube 111, and press rollers 113F and 113S that are rotatably supported by the rotary body 120.

The frame 112 is provided with two insertion openings 112*a* and 112*b* into which the tube 111 is inserted. The tube 111 has portions at which the tube 111 starts to be curved along the inner circumferential surface 112*c* after entering the frame 112 from the insertion openings 112*a* and 112*b*. The tube intersects in an axial direction of the inner circumferential surface 112*c* such that the curved portions of the tube overlap in the axial direction of the inner circumferential surface 112*c*. Therefore, the ring 111*c* of the tube 111 does not have an interrupted portion (leak point) in plan view.

The rotary body 120 rotates around the rotary shaft 114 positioned on the inner circumference side of the ring 111*c* of the tube 111 by power of a drive source 109 in a first rotating direction (counterclockwise direction represented by an arrow in FIG. 6) and a second rotating direction (clockwise direction in FIG. 6) which is an opposite direction to the first rotating direction. The press rollers 113F and 113S are locked to the rotary body 120 that performs rotation in the frame 112 and thus revolves while pressing the tube 111. In this manner, a fluid in the tube 111 is pumped in the rotating direction of the rotary body 120.

The rotary body 120 is provided with a first locking portion 121 that locks a first press roller 113F during the rotation in the first rotating direction, and a second locking portion 122 that locks a second press roller 113S during the rotation in the second rotating direction. In addition, the rotary body 120 is provided with a first curved guide portion 123 that is curved into a helical shape as the first curved guide portion is closer to the rotary shaft 114 from the first locking portion 121 in the first rotating direction, and a second curved guide portion 124 that is curved into a helical shape as the second curved guide portion is closer to the rotary shaft 114 from the second locking portion 122 in the second rotating direction. The press rollers 113F and 113S are disposed to have the axial direction parallel to the axial direction of the rotary shaft 114, and are provided, on both end sides thereof, with engaging shaft portions 113*a* that engage with the rotary body 120.

The rotary body 120 of the embodiment is provided with a first guide portion 125 having a groove shape in which the first locking portion 121 and the first curved guide portion 123 are formed and a second guide portion 126 having a groove shape in which the second locking portion 122 and the second curved guide portion 124 are formed. As illustrated in FIG. 6, it is preferable that the first guide portion 125 and the second guide portion 126 be symmetrically disposed with respect to a straight line passing through the axial center of the rotary shaft 114 as a symmetrical axis, in a plan view illustrated in FIG. 6.

The tube pump 110 of the embodiment includes, as the press roller, the first press roller 113F that engages with the first guide portion 125 and the second press roller 113S that engages with the second guide portion 126. The first press roller 113F and the second press roller 113S press different regions of the ring 111*c* of the tube 111 having a ring shape in the frame 112.

Figure 7:
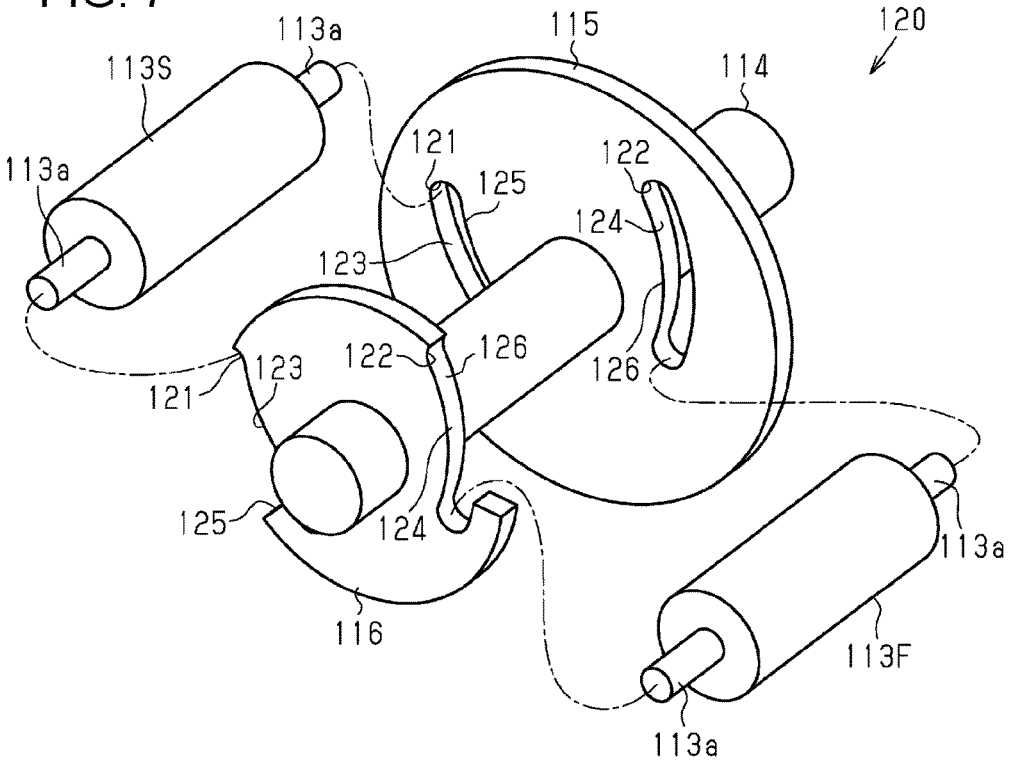
FIG. 7 is a perspective view of a rotary body and a press roller provided in the tube pump in FIG. 6.

As illustrated in FIG. 7, the rotary body 120 includes the rotary shaft 114, a large diameter plate 115 having a disc shape that is disposed on one end side of the rotary shaft 114, and a small diameter plate 116 that is disposed on the other end side of the rotary shaft 114. The large diameter plate 115 is provided with the first guide portion 125 and the second guide portion 126 as through-holes and the small diameter plate 116 is provided with the first guide portion 125 and the second guide portion 126 as notches whose outer edges are cut out.

The engaging shaft portions 113*a* that project from both ends in the axial direction engage with the guide portions 125 and 126 of the large diameter plate 115 and the small diameter plate 116, respectively, and thereby the press rollers 113F and 113S revolve around the rotary shaft 114 in response to the rotation of the rotary body 120. Note that each of positions observed when the press rollers 113F and 113S are locked to the locking portions 121 and 122, respectively, is referred to as a blocking position (press position) at which the tube 111 is pressed and the channel of the tube is blocked. In addition, each of positions observed when the press rollers 113F and 113S are locked to end portions on the opposite side to the locking portions 121 and 122 of the guide portions 125 and 126 is referred to as a canceling position at which the blocking of the channel of the tube 111 is canceled. In addition, the end portions on the opposite side to the locking portions 121 and 122 of the guide portions 125 and 126 are also parts of the curved guide portions 123 and 124, respectively. Even when the press rollers 113F and 113S do not necessarily reach the canceling position, the press rollers 113F and 113S are separated from the locking portions 121 and 122, and thereby the press of the tube 111 is canceled.

The rotary body 120 is provided with the first guide portion 125 and the second guide portion 126 that extend in the rotating direction of the rotary body 120 as an example of a guide portion that guides the press rollers 113F and 113S between the blocking position and the canceling position. The first guide portion 125 and the second guide portion 126 guide one of the press rollers 113F and 113S to the blocking position and the other press roller to the canceling position depending on the rotating direction of the rotary body 120. The tube 111 has a channel that is blocked by the press of one of the press rollers 113F and 113S through the rotation of the rotary body 120 in one direction, and the blocking of the channel is temporarily canceled through a reversing process in the other direction of the rotary body 120. Then, the rotation in the other direction after the canceling of the blocking causes the channel to be blocked through the press performed by the other roller of the press rollers 113F and 113S.

Next, an operation of the tube pump 110 will be described.

In FIG. 6, in a case where a fluid flows from the left side (upstream) to the right side (downstream) of the tube 111, which are placed outside the frame 112, the rotary body 120 rotates in the second rotating direction (clockwise direction in FIG. 6) by the power of the drive source 109.

In FIG. 6, in a case where a fluid flows from the right side (downstream) to the left side (upstream) of the tube 111, which are placed outside the frame 112, the rotary body 120 rotates in the first rotating direction (counterclockwise direction represented by an arrow in FIG. 6) by the power of the drive source 109.

Then, as illustrated in FIG. 6, the first press roller 113F is disposed at the press position at which the first press roller is locked to the first locking portion 121 of the first guide portion 125, and the second press roller 113S is disposed at the canceling position of the second guide portion 126. Then, the first press roller and the second press roller revolve along the inner circumferential surface 112*c* of the frame 112 in a state in which the first press roller 113F presses the tube 111, and the second press roller 113S does not press the tube 111. In this manner, while the fluid in the tube 111 is pressed out on the downstream side in the first rotating direction, the fluid in a portion, in which the pressing is canceled, is suctioned from the upstream side on which the tube 111 is widened.

In addition, in a case where a flowing direction of the fluid is reversed from this state, the rotating direction of the rotary body 120 is reversed from the first rotating direction to the second rotating direction (clockwise direction in FIG. 6). Then, the first press roller 113F locked to the first locking portion 121 moves to the canceling position while being guided by the first curved guide portion 123. In addition, the second press roller 113S disposed at the canceling position of the second guide portion 126 moves to the press position while being guided by the second curved guide portion 124 and is locked to the second locking portion 122. In a reverse process, the one press roller 113F cancels the press of the tube 111, and the two press rollers 113F and 113S engage with the curved guide portions 123 and 124 at the same timing such that the pressure in the tube 111 is reset to the atmospheric pressure. Then, the other press roller 113S starts to press the tube 111.

Then, the first press roller and the second press roller revolve along the inner circumferential surface 112*c* of the frame 112 in a state in which the first press roller 113F does not press the tube 111, and the second press roller 113S presses the tube 111. In this manner, while the fluid in the tube 111 is pressed out in the second rotating direction, a portion, in which the pressing is canceled, is widened and the fluid is suctioned from the portion.

When the pumping of the fluid is ended, the rotating direction of the rotary body 120 is reversed, and the rotation of the rotary body 120 is stopped at a position at which the two press rollers 113F and 113S engage with the curved guide portions 123 and 124, respectively. In this manner, in a state in which the pressure in the tube 111 is reset to the atmospheric pressure, the drive of the tube pump 110 is stopped. As described above, a phenomenon in which the pressing by the press rollers 113 is canceled such that the pressure in the tube 111 is reset to the atmospheric pressure is referred to as pump release.

In the guide portions 125 and 126, the curved guide portions 123 and 124 around the rotary shaft 114 may have the same shape and length. In this manner, when the rotary body 120 is reversed, the second press roller 113S engages with the second curved guide portion 124 at the same timing when the first press roller 113F engages with the first curved guide portion 123.

In a case where the tube pump 110 is used in the pump 86 for regulating pressure, one end of the tube 111 extending in the rightward direction in the tube pump 110 in FIG. 6 is connected to the gas channel 87. Therefore, the rotary body 120 rotates in the first rotating direction (one direction as the counterclockwise direction represented by an arrow in FIG. 6) by the power of the drive source 109. In this manner, the fluid flows from one end side (right side) to the other end side (left side) of the tube 111, and the pump 86 suctions gas. Meanwhile, the rotary body 120 rotates in the second rotating direction (the other direction as the clockwise direction in FIG. 6), and thereby the gas is sent out from the one end side of the tube 111.

Next, an operation of the liquid ejecting apparatus 11 will be described with the details of control performed by the control unit 100.

When a large amount of liquid remains immediately after replacement with a new liquid container 20 is performed or the like, the control unit 100 does not drive the pumping mechanism 38, and the liquid is supplied by the water head of the liquid contained in the liquid container 20 with respect to the nozzle 36.

When the pump chamber 61 of the pumping mechanism 38 is provided with the communication groove 61*a*, and the bifurcated channels 37*b* having a different route from that of the bifurcated channels 37*a* disposed in the pumping mechanism 38, it is possible to maintain a communication state of the liquid supply channel 37 between the liquid container 20 and the liquid ejecting unit 33 even in a state in which the pump chamber 61 has the minimum volume, and thus it is possible to supply the liquid by the water head.

In a case where a liquid is contained in the liquid containing portion 21, and a small amount of liquid remains, the liquid is unlikely to flow out by reaction force of the liquid containing portion 21 which is a bag. Therefore, it is preferable that the pumping mechanism 38 be driven such that the control unit 100 switches to the supply of the liquid by the pumping mechanism 38. In the configuration, the liquid in the liquid containing portion 21 is suctioned by the drive of the pumping mechanism 38, and it is possible to perform pressurization and supply to the liquid ejecting unit 33.

In addition, when the rotary body 120 rotates in the first rotating direction (counterclockwise direction represented by an arrow in FIG. 6) by the power of the drive source 109, the gas flows from one end side (right side) to the other end side (left side) of the tube 111, and the pump 86 suctions gas. Therefore, the gas is suctioned through the gas channel 87. At this time, the one-way valve 85 provided on the depressurization channel 49 allows gas to flow in a direction in which the depressurization chamber 48 is depressurized and restricts the gas from flowing in a direction in which the depressurization chamber 48 is pressurized. Therefore, even when the drive of the pump 86 is stopped, the depressurization chamber 48 maintains the negative pressure. As a result, even after the depressurization drive of the pump 86 is stopped, bubbles or dissolved gas is removed from the liquid stored in the degassing chamber 46. Note that, at this time, since the gas in the pressurization chamber 83*a* of the pressurization bag 83 is suctioned through the pressurization channel 84, the pressurization bag 83 is only contracted and does not press the flexible membrane 77. Therefore, the pressure regulating mechanism 70 maintains the closed state.

Meanwhile, when the rotary body 120 rotates in the second rotating direction (clockwise direction in FIG. 6) by the power of the drive source 109, the gas flows from the other side to the one end side of the tube 111, and the pump 86 sends the gas out. The pressurization bag 83 is inflated with the gas supplied to the pressurization chamber 83*a* through the pressurization channel 84 and presses the pressure chamber 73 which is a part of the liquid supply channel 37. The inflated pressurization bag 83 presses the pressure chamber 73 via the flexible membrane 77 and causes the pressure receiving member 75 to be displaced in a valve opening direction. As a result, the communication hole 72 of the pressure regulating mechanism 70 is opened, and the pressurization cleaning is performed by causing the liquid pressurized from the liquid ejecting unit 33 to flow out (to be discharged). The pressurization cleaning causes foreign matter such as bubbles in the liquid in the liquid ejecting unit 33 to be discharged along with the liquid from the nozzle 36. The liquid discharged from the nozzles 36 is contained as the waste liquid into the waste liquid container 57 through the suction channel 58. When cleaning end time comes, the drive of the drive source 109 is stopped, a predetermined amount of reversing is performed, and release from the pump 86 to the atmospheric pressure is performed. As a result, the pressurization chamber 83*a* is opened to the atmosphere. In this manner, the press of the pressure chamber 73 is canceled via the flexible membrane 77 by the pressurization bag 83, and the pressurization cleaning is ended.

During the pressurization drive of the pump 86, the one-way valve 85 provided on the depressurization channel 49 restricts the gas from flowing in a direction in which the depressurization chamber 48 is pressurized. Therefore, the depressurization chamber 48 maintains the negative pressure even during the pressurization drive of the pump 86. As a result, even during the pressurization drive of the pump 86, it is possible to continue a degassing process of removing bubbles or dissolved gas from the liquid stored in the degassing chamber 46.

In addition, the reason of providing the pressurization bag 83 in the accommodation chamber 82 of the pressure regulating mechanism 70 is as follows. Even when the gas is directly supplied to the accommodation chamber 82 without the pressurization bag 83, it is possible to press the pressure chamber 73 via the flexible membrane 77. However, then, when the pump 86 is subjected to the depressurization drive and the accommodation chamber 82 has a pressure lower than the atmospheric pressure, the pressure applied to a surface of the flexible membrane 77 on the accommodation chamber 82 side is changed. The state of the valve body 74 of the pressure regulating mechanism 70 is switched from the closed state to the opened state when the pressure (internal pressure) which is applied to the surface of the flexible membrane 77 on the inner side as the pressure chamber 73 side is lower than a pressure (external pressure) which is applied to the surface of the flexible membrane 77 on an outer side as the accommodation chamber 82 side of the pressure chamber 73, and a difference between the pressure applied to the surface on the inner side and the pressure applied to the surface on the outer side is equal to or larger than the predetermined value. Therefore, when the accommodation chamber 82 has a pressure lower than the atmospheric pressure, the pressure in the pressure chamber 73 with which the valve body 74 is switched from the closed state to the opened state is also reduced in response to reduction in pressure in the accommodation chamber 82. Variations in the pressure in the pressure chamber 73 with which the valve body 74 is switched from the closed state to the opened state inhibit the meniscus having an appropriate shape of the liquid from being formed in the nozzle 36. This is one reason of inhibiting the liquid from being normally ejected from the liquid ejecting unit 33.

In the example, a configuration, in which the pressurization bag 83 that functions as a press portion capable of pressing the pressure chamber 73 is accommodated in the accommodation chamber 82, is employed. Therefore, the pressurization chamber 83*a* in the press portion (pressurization bag 83 in the example) is depressurized during the depressurization drive of the pump 86, the pressing of the press portion is only canceled, and a region out of the press portion in the accommodation chamber 82 maintains the atmospheric pressure. Therefore, the pressure in the pressure chamber 73, with which the valve body 74 of the pressure regulating mechanism 70 is switched from the closed state to the opened state, is maintained as a desired value. As a result, since the liquid ejecting unit 33 can eject the liquid in a state in which a meniscus having an appropriate shape is formed from the nozzle 36, it is possible to maintain a normal ejecting state of the liquid from the liquid ejecting unit 33.

Next, an operation of the tube pump 110 will be described.

In the tube pump 110, even in a case where the rotary body 120 rotates in any rotating direction, one of the press rollers 113F and 113S maintains a state of pressing the tube 111 and can continuously rotate, and thus it is possible to continuously pump the fluid.

Here, the pressure in the tube 111, through which the fluid is pumped from upstream to downstream, is the negative pressure on the upstream side from a position at which the first press roller 113F is pressed (a state in which initial pressure measured at the start of the pumping is reduced), and the pressure on the downstream side from the position is the positive pressure (a state in which initial pressure measured at the start of the pumping is increased). Therefore, in a case where the guide portions 125 and 126 do not include the curved guide portions 123 and 124, respectively, and revolving directions of the press rollers 113F and 113S are simply reversed such that the pumping in an opposite direction is started, a problem arises in that there are variations in a value of the initial pressure at the time of reversing. In order to solve the problem, the pressure in the tube 111 is measured with a pressure sensor or the like, and the rotary body 120 needs to rotate until a target pressure is obtained.

In this respect, in the tube pump 110 of the embodiment, the pressing of the tube 111 by one of the press rollers 113F and 113S is canceled such that a pressurization state and a depressurization state in the tube 111 are canceled, and then the other roller of the press rollers 113F and 113S starts the pressing of the tube 111.

In other words, when the rotating direction of the rotary body 120 is reversed, the press rollers 113F and 113S engage with the first curved guide portion 123 and the second curved guide portion 124, and the pressing of the tube 111 is canceled. Therefore, in a case where the hollow portion 111*a* is opened to the atmosphere at an end portion of the tube 111, the pressure in the tube 111 is reset to the atmospheric pressure in the reversing process. Therefore, the initial pressure is set to the atmospheric pressure when the pumping is started in another direction through the reversing without providing a pressure sensor or the like, and thus it is possible to control the drive of the tube pump 110 based on the number of rotations or a rotation angle of the rotary body 120.

In addition, when the drive of the tube pump 110 is stopped, the two press rollers 113F and 113S engage with the curved guide portions 123 and 124, respectively, and thereby it is possible to cancel the pressing of the tube 111. Therefore, it is possible to cause the fluid in the tube 111 to flow upstream and downstream of the tube pump 110. In addition, it is possible to reduce a load applied to the tube 111 by the pressing.

In a case where the tube pump 110 is used in the pump 86, the rotary body 120 rotates in the first rotating direction (one direction as the counterclockwise direction represented by an arrow in FIG. 6) by the power of the drive source 109. At this time, the press roller 113F disposed at the blocking position revolves in the first rotating direction while pressing the tube 111. In this manner, the fluid flows from one end side (right side) to the other end side (left side) of the tube 111, and the pump 86 suctions gas. Next, when the rotary body 120 rotates by the power of the drive source 109 in the second rotating direction which is the opposite side to the first rotating direction, first, the press roller 113F moves to the canceling position such that the pressing of the tube 111 is canceled, and thereby the pressurization state and the depressurization state are canceled in the tube 111 such that the pressure in the tube 111 is reset to the atmospheric pressure. Subsequently, the press roller 113S moves to the blocking position and the pressing of the tube 111 starts. The press roller 113F disposed at the blocking position revolves in the second rotating direction while pressing the tube 111. In this manner, the fluid flows from the other end side (left side) to the one end side (right side) of the tube 111, and the pump 86 sends out gas.

According to the embodiment described above, it is possible to obtain the following effects.

(1) The liquid ejecting apparatus 11 includes the carriage 32 on which the liquid ejecting unit 33 is mounted to eject, to the medium S, the liquid supplied from the liquid container 20 via the liquid supply channel 37 and which moves with respect to the medium S. In addition, the carriage 32 is provided with the depressurization chamber 48 and the pressurization chamber 83*a* which configure an example of the gas containing chamber that normally maintains the ejecting state of the liquid from the liquid ejecting unit 33. In addition, the pump 86 is disposed outside the carriage 32 of the liquid ejecting apparatus 11 and is capable of sending gas out to the one system of gas channel 87 connected to the depressurization chamber 48 and the pressurization chamber 83*a* and suctioning gas from the gas channel 87. The pressure regulating mechanism is configured to include the gas containing chamber (the depressurization chamber 48 and the pressurization chamber 83*a*) which is mounted on the carriage 32, the gas channel 87, and the pump 86. Accordingly, since the gas channel 87 that connects the pump 86 and the carriage 32 so as to regulate the pressure of the depressurization chamber 48 and the pressurization chamber 83*a* mounted on the carriage 32 is configured to have one system, it is possible to configure, in a compact manner, the pressure regulating mechanism including the pump 86, the gas channel 87, the depressurization chamber 48, the pressurization chamber 83*a*, and the like.

(2) The gas containing chamber, which is connected to the pump 86 through the one system of gas channel 87, includes the depressurization chamber 48 for defoaming that depressurizes the liquid supply channel 37 and the pressurization chamber 83*a* for the pressurization cleaning that presses the pressure chamber 73 that configures a part of the liquid supply channel 37 such that the liquid is discharged from the liquid ejecting unit 33. Accordingly, the depressurization of the liquid in the liquid supply channel 37 and the discharge of the liquid from the liquid ejecting unit 33 through the pressing of the liquid supply channel 37 are performed, and thereby it is possible to easily and still more normally maintain the liquid ejecting state of the liquid from the liquid ejecting unit 33.

(3) The gas channel 87 is connected, at the connection position 90, to the on-carriage gas channel 89 that connects the depressurization chamber 48 and the pressurization chamber 83*a*. The one-way valve 85 is provided to be closer to the depressurization channel 49 on the depressurization chamber 48 side than to the connection position 90 of the on-carriage gas channel 89, and allows the gas to flow in the direction such that the depressurization chamber 48 is depressurized and restricts the gas from flowing in a direction such that the depressurization chamber 48 is pressurized. The pressurization bag 83 functioning as the pressing portion that presses the pressure chamber 73 which configures a part of the liquid supply channel 37 of the pressurization chamber 83*a* is formed by a flexible member. Accordingly, switching is performed between the pressurization drive by which the pump 86 sends the gas out and the depressurization drive by which the pump suctions the gas, and thereby it is possible to easily realize depressurization of the depressurization chamber 48 and pressurization of the pressurization chamber 83*a* through the one system of gas channel 87. In addition, the pump 86 is subjected to switching from the depressurization drive to the pressurization drive, it is possible to maintain a depressurized state in the depressurization chamber 48. For example, since it is possible to remove bubbles and dissolved gas from the liquid in the degassing chamber 46 divided from the depressurization chamber 48 by the degassing membrane 47, it is possible to maintain the normal ejecting state of the liquid ejecting unit 33.

(4) The liquid supply channel 37 and the gas channel 87 are integrally made of a flexible material. Specifically, the multiple tubes 88 made of a flexible material is used to connect the apparatus main body side and the carriage 32 side in the liquid supply channel 37 and the gas channel 87. The flexible channels 37 and 87, which are connected between the apparatus main body and the carriage 32, can be configured to have a small (compact) size. Further, the pressure regulating mechanism including the depressurization chamber 48 and the pressurization chamber 83*a* which are mounted on the carriage 32 can be configured to have a small size. Therefore, space saving is achieved through a decrease in the size of the pressure regulating mechanism and it is possible to realize to the miniaturization of the liquid ejecting apparatus 11.

(5) Since the second channel diameter of the gas channel 87 is smaller than the first channel diameter of the liquid supply channel 37, it is possible to shorten the time taken to perform depressurization and pressurization until the gas containing chamber (the depressurization chamber 48 and the pressurization chamber 83*a*) has the predetermined pressure after the start of the drive of the pump 86. Hence, since it is possible to rapidly and efficiently perform the degassing and the pressurization cleaning, it is possible to maintain normal liquid ejection from the liquid ejecting unit 33.

(6) The pump 86 is the tube pump 110, the switching is performed between the suction and sending the fluid out by forward and reverse of rotating drive, and the pump is temporarily opened to the atmospheric pressure in the reverse direction. Specifically, The tube pump 110 includes the frame 112 that supports the tube 111 provided with the channel inside of the tube, the rotary body 120 that is rotatable around the axial center by the power from the drive source 109, and the press rollers 113F and 113S which are supported by the rotary body 120 and which rotate (revolve) around the axial center so as to be able to press the tube 111. The rotary body 120 includes guide portions 125 and 126 which configures an example of the guide portion that extends in the rotating direction of the rotary body 120 and is provided with the blocking position at which the channel of the tube 111 is blocked by the press rollers 113F and 113S and the canceling position at which the blocking of the channel is canceled. The tube 111 has the channel that is blocked by the rotation of the rotary body 120 in one direction, and, after the blocking of the channel is canceled by rotation of the rotary body 120 in the other direction from a state in which the channel is blocked, and then the channel is blocked. In other words, one end of the tube 111 is connected to the gas channel 87, gas is suctioned from the one end side of the tube 111 by the rotation of the rotary body 120 in the one direction, and gas is sent out from the one end side of the tube 111 by the rotation of the rotary body 120 in the other direction. Accordingly, the tube pump 110 can be appropriately employed as the pump 86 for both of the pressurization and depressurization. For example, it is possible to control the drive of the tube pump 110 with the initial pressure obtained when the pump 86 starts the reversing (accurately, when the pump reaches the reset position after the reversing) which is set to the atmospheric pressure, based on the number of rotations or a rotation angle of the rotary body 120. In this case, one type of sensor such as the pressure sensor may not be provided, and further it is easy to control the pump 86 by the control unit 100.

(7) The tube pump 110 includes one rotary body 120 provided with the two guide portions 125 and 126, and the press rollers 113F and 113S that engage with the guide portions 125 and 126, respectively. Therefore, the fluid is pumped in the first rotating direction through the pressing by the first press roller 113F, and the fluid is pumped in the second rotating direction through the pressing by the second press roller 113S.

Second Embodiment of Tube Pump

Next, a second embodiment of the tube pump will be described with reference to the figures.

Figure 8:
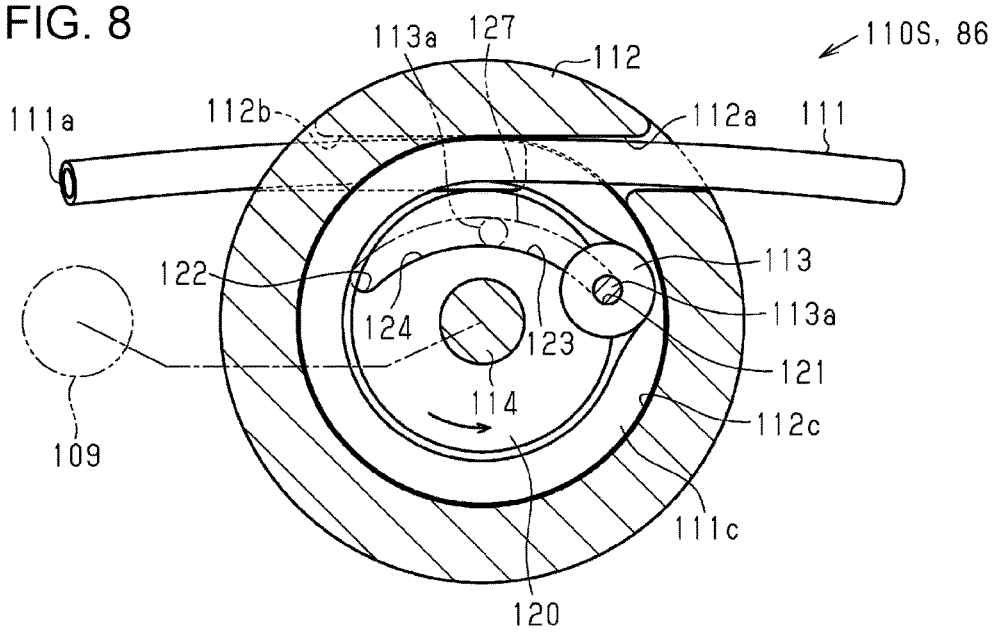
FIG. 8 is a sectional view illustrating a second embodiment of the tube pump.

As illustrated in FIG. 8, a tube pump 110S of the second embodiment is the same as that of the first embodiment, and is a tube pump that is provided at a position on the tube 111 having the hollow portion 111*a* which forms the channel. Thus, the same reference signs are assigned to the same configurations as those of the first embodiment, and the following description focuses on different configurations from those of the first embodiment.

The tube pump 110S includes the frame 112 that supports the tube 111, the rotary body 120 that is rotatable around the axial center by the power from the drive source 109, and the press roller 113 which is supported by the rotary body 120 and which rotates around the axial center so as to be able to press the tube 111. The rotary body 120 is provided with the first locking portion 121 and the second locking portion 122 at both ends thereof and is provided with a guide portion 127 as an example of the guide portion provided with the first curved guide portion 123 and the second curved guide portion 124 which are continuously disposed between the first locking portion 121 and the second locking portion 122. The press roller 113 engages with the guide portion 127 and the rotating direction of the rotary body 120 is reversed, the press roller 113 passes through the first curved guide portion 123 and the second curved guide portion 124 and moves between the first locking portion 121 and the second locking portion 122.

For example, in FIG. 8, in a case where a fluid flows from the right side (upstream) to the left side (downstream) of the tube 111, which are placed outside the frame 112, the rotary body 120 rotates in the first rotating direction (counterclockwise direction represented by an arrow in FIG. 8) by the power of the drive source 109.

Then, as illustrated in FIG. 8, after the press roller 113 is disposed at the press position at which the press roller is locked to the first locking portion 121 of the guide portion 127, the press roller revolves along the inner circumferential surface 112*c* of the frame 112 in a state of pressing the tube 111. In this manner, the fluid in the tube 111 is pumped to the downstream side in the first rotating direction.

In addition, when the rotating direction of the rotary body 120 is reversed from the first rotating direction to the second rotating direction (clockwise direction in FIG. 8) from this state, the engaging shaft portion 113*a* of the press roller 113 locked to the first locking portion 121 moves to the canceling position (represented by a two-dot chain line in FIG. 8) while the engaging shaft portions is guided along the first curved guide portion 123. In this manner, the pressing of the tube 111 by the press roller 113 is canceled. In a case where the hollow portion 111*a* is opened to the atmosphere at the end portion of the tube 111, the pressure in the tube 111 is reset to the atmospheric pressure.

Subsequently, when the press roller 113 disposed at the canceling position moves to the press position at which the press roller is locked to the second locking portion 122 while being guided along the second curved guide portion 124, the press roller 113 revolves along the inner circumferential surface 112*c* of the frame 112 in a state of pressing the tube 111. In this manner, a fluid in the tube 111 is pumped in the second rotating direction.

When the pumping of the fluid is ended, the rotating direction of the rotary body 120 is reversed, and the rotation of the rotary body 120 is stopped at a position at which the press roller 113 engages with the first curved guide portions 123 or the second curved guide portion 124. In this manner, in a state in which the pressing of the ring 111*c* by the press roller 113 is canceled and the pressure in the tube 111 is reset to the atmospheric pressure, the drive of the tube pump 110 is stopped.

According to the embodiments described above, it is possible to obtain the following effects.

(8) Since one press roller 113 and one guide portion 127 may be provided, it is possible to simplify the configuration. Accordingly, the tube pump 110S can be appropriately employed as the pump 86 for both of the pressurization and depressurization.

Third Embodiment of Tube Pump

Next, a third embodiment of the tube pump will be described with reference to the figures.

Figure 9:
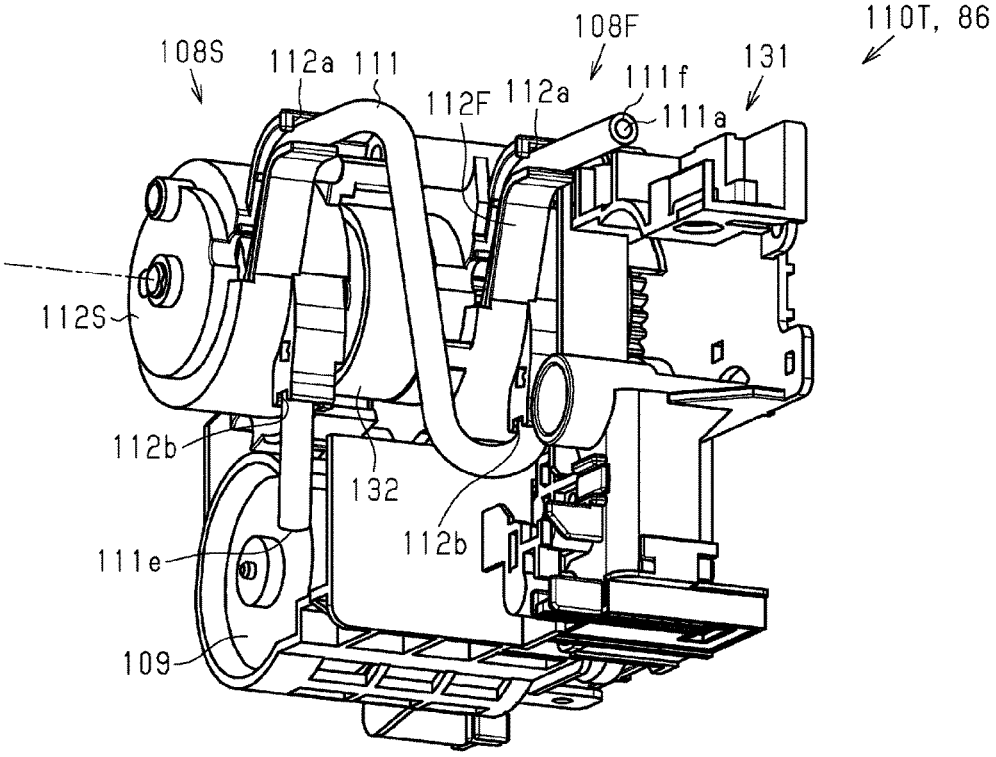
FIG. 9 is a sectional view illustrating a third embodiment of the tube pump.

As illustrated in FIG. 9, a tube pump 110T of the third embodiment is the same as that of the first embodiment, and is a tube pump that is provided at a position on the tube 111 having the hollow portion 111*a* which forms the channel. Thus, the same reference signs are assigned to the same configurations as those of the first embodiment, and the following description focuses on different configurations from those of the first embodiment.

The tube pump 110T of the embodiment includes a first pump 108F and a second pump 108S which are disposed side by side in the axial direction (axial center represented by a dot-and-dash line in FIG. 9). The tube pump 110T includes, as the frame 112, a first frame 112F that configures the first pump 108F and a second frame 112S that configures the second pump 108S. In addition, the tube pump 110T includes a power transmitting mechanism 131 that transmits power of the drive source 109 to the first pump 108F and the second pump 108S.

In a case where the tube pump 110T is the pump 86 illustrated in FIG. 5, an exposure portion 111*f* exposed from the first frame 112F of the tube 111 illustrated in FIG. 9 is connected to the gas channel 87 so as to communicate with the pressurization channel 84, which sends the pressurized gas to the pressurization bag 83, and the depressurization channel 49 for depressurizing the depressurization chamber 48. In a case where the pressurized gas is discharged from an end portion 111*e* of the tube 111 in response to the drive by the tube pump 110T, and the end portion 111*e* is disposed toward the drive source 109 or the like, it is possible to use the exhaust for cooling the drive source 109. The target to be cooled is not limited to the drive source 109, and a motor, a power circuit, or the like which drives another configurational member may be cooled.

A portion of the tube 111, which is connected to the exposure portion 111*f*, enters the first frame 112F through the insertion opening 112*a* of the first pump 108F, and the tube 111 out from the insertion opening 112*b* of the first frame 112F enters the second frame 112S through the insertion opening 112*a* of the second pump 108S. An end of the tube 111 out from the insertion opening 112*b* of the second frame 112S is the end portion 111*e*.

Figure 10:
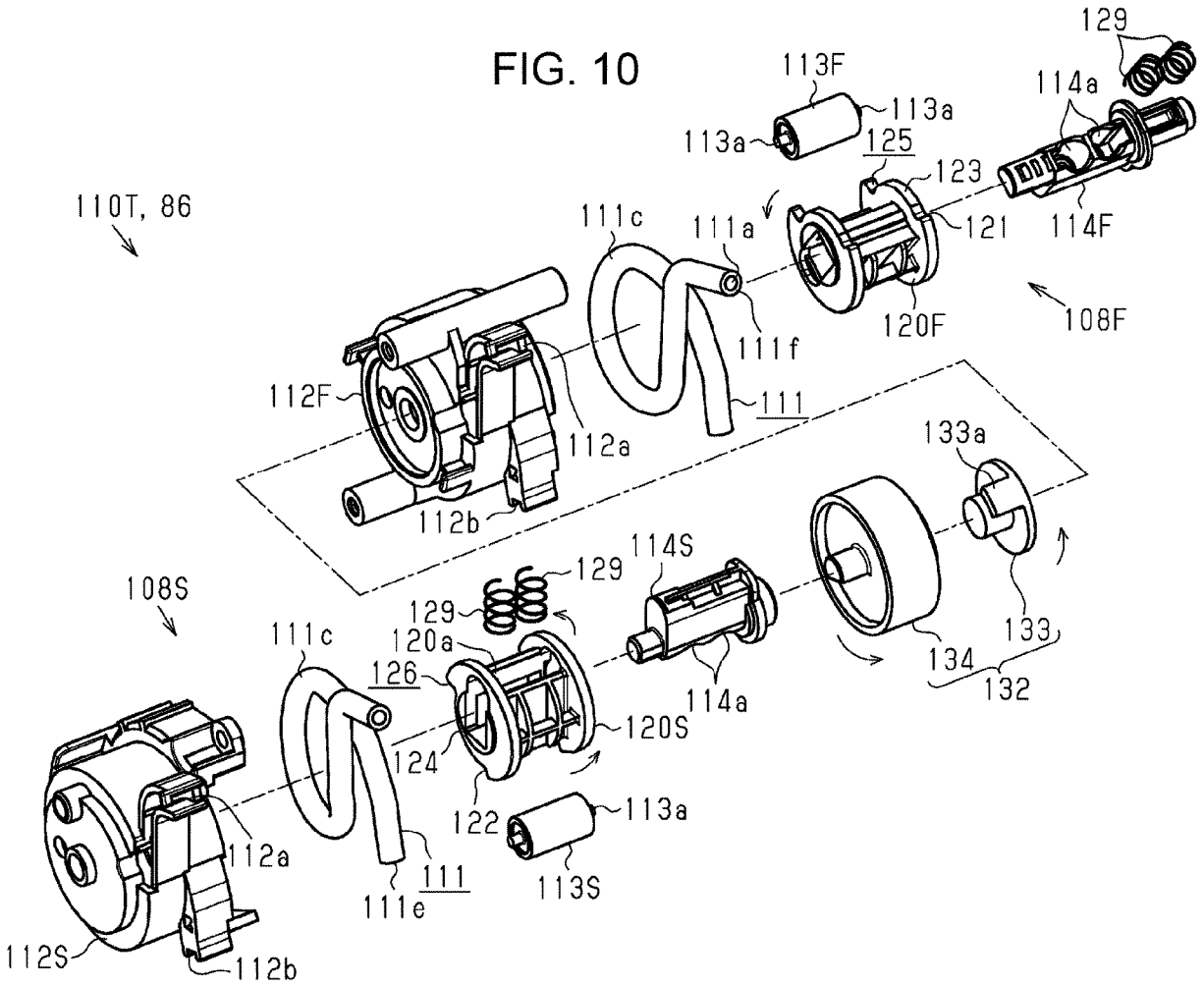
FIG. 10 is an exploded perspective view of the tube pump in FIG. 9.

As illustrated in FIG. 10, the tube pump 110T includes, as the rotary body 120, a first rotary body 120F that is provided with the first guide portion 125 and is accommodated in the first frame 112F, and a second rotary body 120S that is provided with the second guide portion 126 and is accommodated in the second frame 112S. The guide portions 125 and 126 engage with the press rollers 113F and 113S, respectively. The guide portions 125 and 126 extend in the rotating direction of the rotary bodies 120F and 120S, and configure an example of the guide portion that guides the press rollers 113F and 113S between the blocking position at which the channel of the tube 111 is blocked and the canceling position at which the blocking of the channel is canceled. In addition, the tube pump 110T includes a first rotary shaft 114F as a separate body from the first rotary body 120F, and a second rotary shaft 114S as a separate body from the second rotary body 120S.

The first rotary body 120F and the second rotary body 120S are disposed side by side in an axial direction of the rotary shafts 114F and 114S that rotate by power of one drive source 109 (refer to FIG. 9). A portion of the tube 111 is accommodated in the frames 112F and 112S that surround the rotary bodies 120F and 120S, respectively, and forms the respective rings 111*c*. The first press rollers 113F and 113S press different regions that form the respective different rings 111*c* of the tube 111.

For example, in a case where the rotary bodies 120F and 120S rotate in the first rotating direction represented by the arrow in FIG. 10, the first press roller 113F is guided to the blocking position at which the channel of the tube 111 is blocked, and the second press roller 113S is guided to the canceling position at which the blocking of the channel of the tube 111 is canceled. In a state in which the first press roller 113F guided to the blocking position presses the tube 111, and the second press roller 113S guided to the canceling position does not press the tube 111, the press rollers revolve, and pumps the fluid from the end portion 111*e* of the tube 111 to the exposure portion 111*f* side. In addition, in a case where the rotary bodies 120F and 120S rotate in the second rotating direction, the press rollers revolve in a state in which the first press roller 113F is guided to the canceling position and does not press the tube 111, and the second press roller 113S guided to the blocking position presses the tube 111, and pumps the fluid from the end portion 111*e* of the tube 111 to the exposure portion 111*f* side. In a case where the tube pump 110T is used as the pump 86 for both of pressurization and depressurization, the rotary bodies 120F and 120S rotate in the first rotating direction and are driven through pressurization, and gas is sent out from the exposure portion 111*f* of the tube 111. The rotary bodies 120F and 120S rotate in the second rotating direction and are driven through depressurization, and the gas is suctioned toward the exposure portion 111*f* of the tube 111.

The power of the drive source 109 (refer to FIG. 9) is transmitted to the first rotary body 120F via the first rotary shaft 114F, and is transmitted to the second rotary body 120S from the first rotary body 120F via the second rotary shaft 114S. Here, it is preferable that the power transmitting mechanism 131 be provided with a rotation delay portion 132 that causes the rotation of the first rotary body 120F to be delayed and transmits the delayed rotation to the second rotary shaft 114S and the second rotary body 120S.

Figure 11:
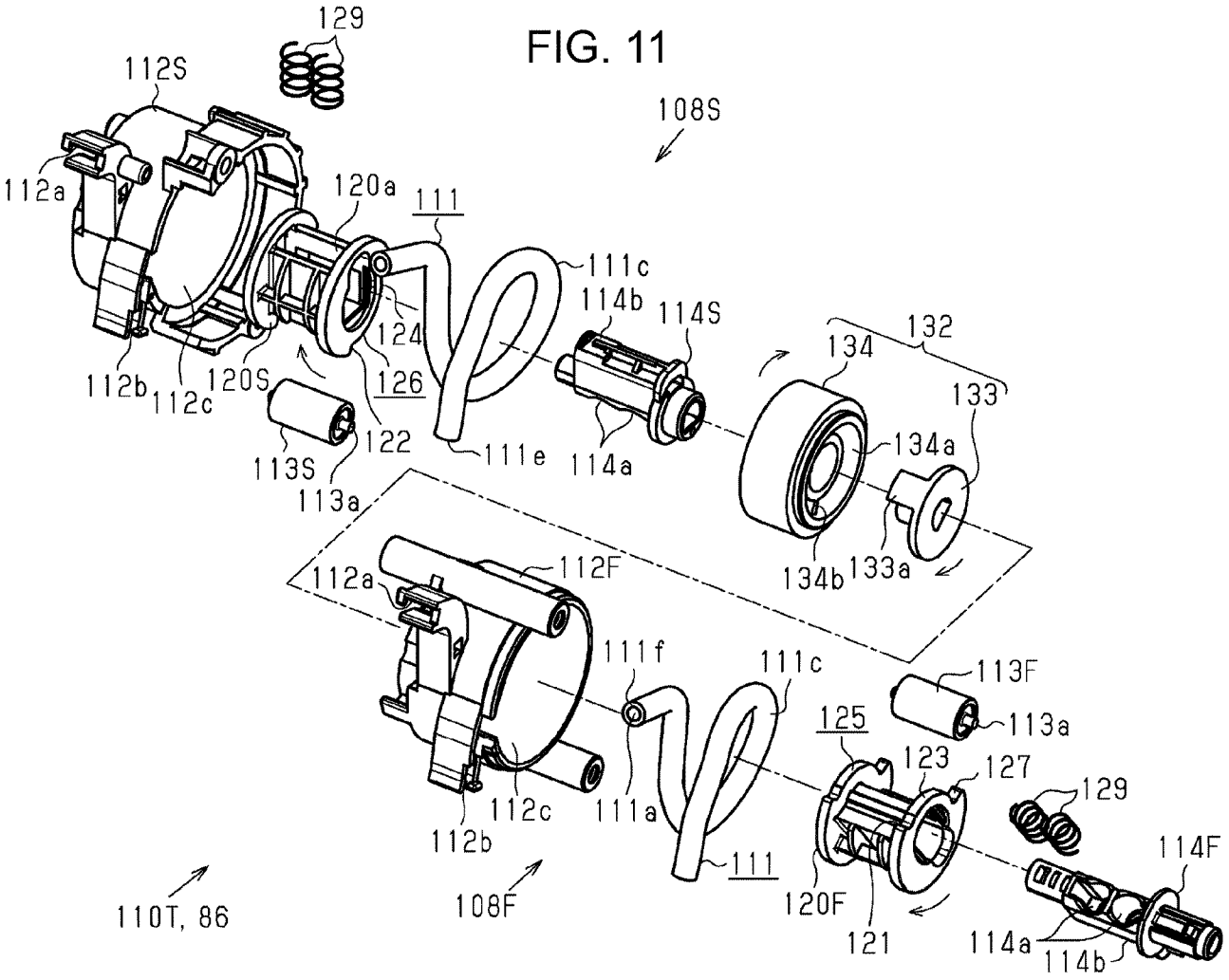
FIG. 11 is an exploded perspective view of the tube pump in FIG. 9.

As illustrated in FIG. 11, the rotation delay portion 132 is configured to include a first rotary member 133 provided with an engagement protrusion 133*a* and a second rotary member 134 provided with a cam groove 134*a* with which the engagement protrusion 133*a* can engage. The cam groove 134*a* has an arc shape that extends along a circumference with the axial core of the second rotary shaft 114S as the center. In addition, the second rotary member 134 is provided with a locking protrusion 134*b* that forms a starting end and a terminal end of the cam groove 134*a*.

The first rotary member 133 is assembled to integrally rotate along with the first rotary shaft 114F, and the second rotary member 134 is assembled to integrally rotate along with the second rotary shaft 114S. In addition, in a state in which the engagement protrusion 133*a* of the first rotary member 133 is inserted into the cam groove 134*a* of the second rotary member 134, the first rotary member 133 and the second rotary member 134 are assembled.

In the configuration, when the first rotary shaft 114F rotates in the first rotating direction represented by the arrow in FIG. 11, the first rotary body 120F rotates in the first rotating direction, and the first press roller 113F is guided to the blocking position (press position) at which the channel of the tube 111 is blocked and the first press roller presses the tube 111. In addition, when the first rotary member 133 rotates along with the first rotary shaft 114F, the engagement protrusion 133*a* rotates along the cam groove 134*a*. When the engagement protrusion 133*a* collides with the locking protrusion 134*b*, the second rotary member 134 is pushed by the engagement protrusion 133*a* and starts to rotate. Then, the second rotary shaft 114S and the second rotary body 120S rotate along with the second rotary member 134 in the first rotating direction. As described above, the rotation of the first rotary body 120F is delayed by a rotation angle obtained when the engagement protrusion 133*a* rotates along the cam groove 134*a*, and the delayed rotation is transmitted to the second rotary body 120S.

When the rotating direction of the first rotary shaft 114F is reversed from this state, the first rotary body 120F rotates in the second rotating direction, and the first press roller 113F moves from the blocking position at which the channel of the tube 111 is blocked to the canceling position at which the blocking of the channel is canceled such that the pressing of the tube 111 is canceled. During this time, the first rotary member 133 rotates along with the first rotary shaft 114F; however, while the engagement protrusion 133*a* rotates in the second rotating direction along the cam groove 134*a*, the second rotary member 134 is not pushed by the first rotary member 133, and thus the second rotary shaft 114S and the second rotary body 120S do not rotate. Therefore, when the first press roller 113F is separated from the blocking position and moves along the first curved guide portion 123, the pressure in the tube 111 is reset to the atmospheric pressure.

When the engagement protrusion 133*a* rotating in the second rotating direction collides with the locking protrusion 134*b*, the second rotary shaft 114S and the second rotary body 120S starts to rotate along with the second rotary member 134 in the second rotating direction. In this manner, the second press roller 113S moves from the second curved guide portion 124 to the second locking portion 122, and revolves while pressing the tube 111. As described above, even when the rotating direction of the first rotary body 120F is reversed, the rotation thereof is delayed by a rotation angle obtained when the engagement protrusion 133*a* rotates along the cam groove 134*a*, and the delayed rotation is transmitted to the second rotary body 120S.

It is preferable that one or a plurality of (two by two in the embodiment) bias members 129 be interposed between the rotary bodies 120F and 120S and the rotary shafts 114F and 114S, respectively, and the press rollers 113F and 113S be biased toward the tube 111 via the rotary bodies 120F and 120S. It is possible to use a spring such as a coil spring or a leaf spring as the bias member 129. In a case where the bias member 129 is the coil spring, the rotary shafts 114F and 114S may be provided with a recessed locking portion 114*a* in which a proximal portion of the bias member 129 is accommodated, and the rotary bodies 120F and 120S may be provided with a recessed locking portion 120*a* in which a distal portion of the bias member 129 is accommodated.

In addition, the rotary shafts 114F and 114S may be provided with a projecting portion 114*b* that projects in such a way that an outer diameter is increased from the shaft center, and the projecting portion 114*b* may be provided with the recessed locking portion 114*a*. In addition, in the rotary bodies 120F and 120S, a depth of the recessed locking portion 120*a* may be set such that an internal space of the recessed locking portion 120*a* includes the shaft center.

Figure 12:
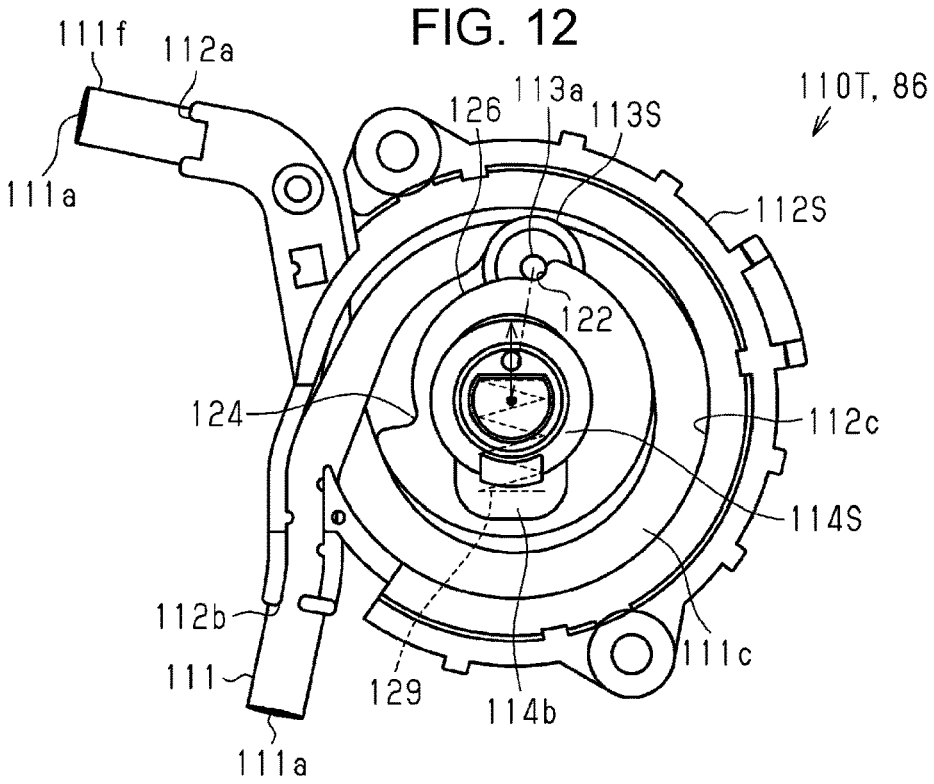
FIG. 12 is a schematic view illustrating an internal configuration of the tube pump in FIG. 9.

Then as illustrated in FIG. 12, it is possible to dispose the bias member 129 such that the bias member overlaps the shaft center. In this manner, it is possible to reduce the diameter of the frames 112F and 112S more than in a case where the bias member 129 is disposed between the shaft center and the press rollers 113F and 113S.

In the second pump 108S illustrated in FIG. 12, it is preferable that the bias direction (represented by an arrow in FIG. 12) be set by the bias member 129 such that bias force of the bias member 129 has a strong effect when the second press roller 113S move between the second curved guide portion 124 and the second locking portion 122. Similarly, in the first pump 108F, it is preferable that the bias direction be set by the bias member 129 such that the bias force of the bias member 129 has a strong effect when the first press roller 113F moves between the first curved guide portion 123 and the first locking portion 121.

According to the embodiments described above, it is possible to obtain the following effects.

(9) Since the press rollers 113F and 113S are biased by the bias member 129 via the rotary bodies 120F and 120S, it is possible to start pressing or to cancel the pressing of the tube 111 with high accuracy when the press rollers 113F and 113S move between the curved guide portions 123 and 124 and the locking portions 121 and 122, respectively. Accordingly, the tube pump 110T can be appropriately employed as the pump 86 for both of the pressurization and depressurization.

(10) Since the first press roller 113F and the first rotary body 120F, and the second press roller 113S and the second rotary body 120S are accommodated in different frames 112F and 112S, respectively, it is possible to dispose the bias member 129 such that the bias member overlaps the shaft center. By comparison, in a case where the two press rollers 113F and 113S accommodated in one frame 112 are each biased by the bias member 129, the bias member 129 is disposed between the shaft center and the press rollers 113F and 113S. Therefore, the diameter of the frame 112F and 112S is increased by a length of the bias member 129. Hence, in the embodiment, it is possible to reduce an increase in diameter of the frame 112 depending on the disposition of the bias member 129.

(11) As the frames 112F and 112S decrease in diameter, the curved guide portions 123 and 124 decrease in length. Therefore, the press rollers 113F and 113S are caused to engage with the curved guide portions 123 and 124 at the same timing, and then it is difficult to cancel the pressing of the tube 111. In this respect, the rotation of the first rotary body 120F is delayed by the rotation delay portion 132 and the delayed rotation is transmitted to the second rotary body 120S, and thereby it is possible to elongate a period of time from the canceling of the pressing by one of the press rollers 113F and 113S to movement of the other of the press rollers 113F and 113S to the press position. Hence, even when the frames 112F and 112S has a small diameter and are provided with the curved guide portions 123 and 124 which are short, it is easy to realize a configuration in which the press rollers 113F and 113S cancel the pressing at the same timing. In addition, it is possible to adjust the timing from the reverse of the rotation to the next pumping, by the length of the cam groove 134*a*.

The embodiments described above may be modified as the following modification examples. In addition, a configuration included in the embodiment and a configuration included in the following modification example may be combined, or configurations included in the following modification examples may be combined.

Figure 13:
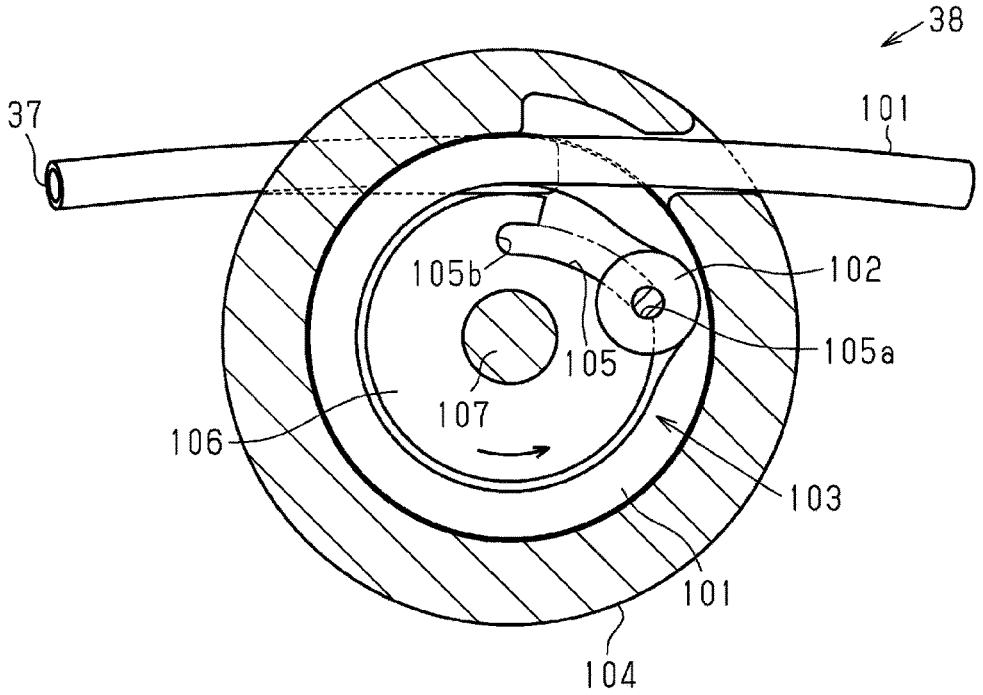
FIG. 13 is a sectional view illustrating a modification example of a pumping mechanism.

As in a modification example illustrated in FIG. 13, the pumping mechanism 38 may be a tube pump provided at a position on a tube 101 that configures the liquid supply channel 37. The pumping mechanism 38 includes a moving mechanism 103 that causes a press roller 102 to move. For example, the moving mechanism 103 includes a cylindrical frame 104 that accommodates the tube 101, a rotary body 106 that is provided with a guide groove 105 which guides the press roller 102 to two positions different in a radial direction and is accommodated in the frame 104, and a rotary shaft 107 that rotates by drive force from a drive source (not illustrated). The rotary body 106 rotates along with the rotary shaft 107, and thereby the press roller 102 revolves.

When the rotary body 106 rotates in the first rotating direction represented by an arrow in FIG. 13, the press roller 102 that is locked to a locking portion 105*a* moves while pressing the tube 101, and the liquid in the tube 101 is pumped. In addition, when the rotary body 106 rotates in the second rotating direction which is an opposite direction to the first rotating direction, the press roller 102 moves to a second end 105*b* of a guide groove 105 and the pressing of the tube 101 is canceled. Therefore, the liquid is not pumped. When switching is performed from supply of the liquid by the pumping mechanism 38 which is the tube pump to supply of the liquid by the water head, the control unit 100 may control the drive source such that the pressing of the tube 101 is canceled by the press roller 102. In this case, even in a case where tube pump does not perform the pumping of the liquid, it is possible to maintain a communication state of the liquid supply channel 37 between the liquid container 20 and the liquid ejecting unit 33, and it is possible to supply the liquid by the water head.

Figure 14:
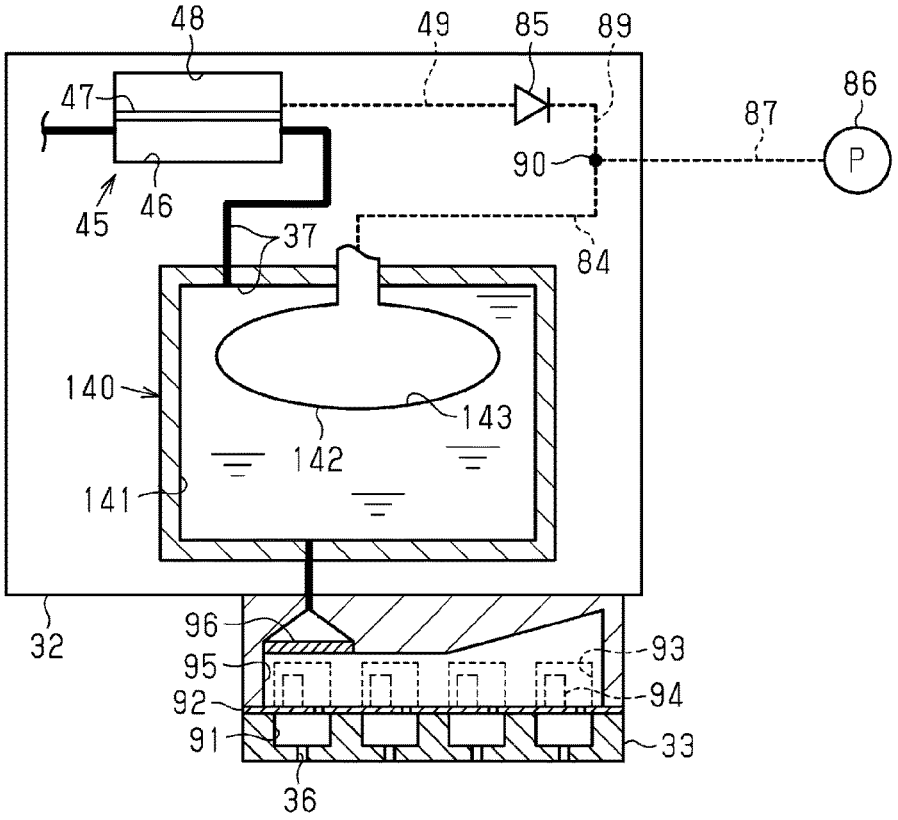
FIG. 14 is a schematic diagram illustrating main parts of a modification example of the pressure regulating mechanism in the liquid ejecting apparatus.

The pressurization chamber that is pressurized when the pump 86 sends gas out may not be limited to the pressurization chamber 83*a* that configures the valve opening mechanism 81 in the pressure regulating mechanism 70. For example, as illustrated in FIG. 14, a subtank 140 that temporarily stores a liquid which is supplied toward the liquid ejecting unit 33 from the liquid container 20 is mounted on the carriage 32. The subtank 140 includes a liquid containing chamber 141 that is a part of the liquid supply channel 37 and is filled with the liquid, and a flexible pressurization bag 142 is accommodated in a liquid containing chamber 141. Therefore, the pressurization bag 142 exists in the liquid in the liquid containing chamber 141. When the gas is supplied to an internal pressurization chamber 143 through the one system of the gas channel 87 from the pump 86, and the pressurization bag 142 is inflated, the liquid pressure in the subtank 140 increases depending on the inflated size. Meanwhile, when the gas in the pressurization bag 142 is reduced and the pressurization bag 142 is contracted, the liquid pressure in the subtank 140 is reduced. For example, the control unit 100 controls the drive of the pump 86, controls pressurization and depressurization of the liquid pressure in the subtank 140, and adjusts back pressure of the liquid ejecting unit 33 such that the back pressure is in a range of a predetermined negative pressure. In this manner, it is possible to maintain the normal ejecting state of the liquid from the liquid ejecting unit 33. Further, gas is supplied from the pump 86 such that the pressurization bag 142 is inflated, and thereby the pressurization cleaning of discharging the liquid from the nozzles 36 of the liquid ejecting unit 33 may be performed.

Figure 15:
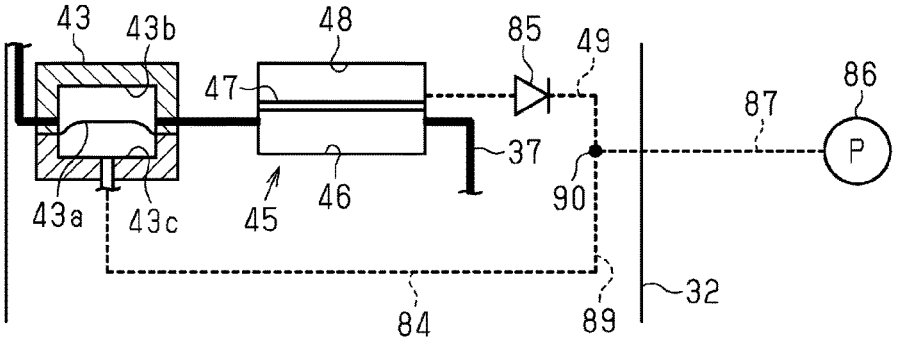
FIG. 15 is a schematic diagram illustrating main parts of another modification example of the pressure regulating mechanism which is different from that in FIG. 14.

The depressurization chamber that is depressurized when the pump 86 suctions the gas is not limited to the depressurization chamber 48 of the degassing mechanism 45 and, for example, may be the liquid storage portion 43. The liquid storage portion 43 illustrated in FIG. 5 is configured to pressurize a part of the liquid supply channel 37 by the bias force of the spring 44; however, as illustrated in FIG. 15, the liquid storage portion 43 may pressurize the liquid storage chamber 43*b* that configures a part of the liquid supply channel 37 by the gas that is supplied from the pump 86 through the gas channel 87 and the pressurization channel 84. The liquid storage portion 43 illustrated in FIG. 15 includes the liquid storage chamber 43*b* that forms a space having a variable volume, a pressurization chamber 43*c* connected to the gas channel 87 and the pressurization channel 84, and a flexible member 43*a* which can be bent and be displaced and by which the liquid storage chamber 43*b* and the pressurization chamber 43*c* are divided. When the gas sent out from the pump 86 is supplied to the pressurization chamber 43*c*, the internal pressure of the pressurization chamber 43*c* increases and thus the flexible member 43*a* is bent and deformed to a side (upper side in FIG. 15) on which the volume of the liquid storage chamber 43*b* is reduced. In this manner, the pressure of the liquid stored in the liquid storage chamber 43*b* increases. At this time, in a case where the pumping mechanism 38 is a diaphragm pump, a suction operation and a discharge operation are alternately performed during the drive of the pump, and a so-called "break" in which the liquid is not sent out in a process of the suction operation periodically occurs. It is desirable that the control unit 100 controls the pressurization and drive of the pump 86 at the break timing when the pressure of the liquid in the liquid storage chamber 43*b* is reduced. In the configuration, it is possible to supply the liquid to the downstream side of the liquid storage portion 43 with the stable pressure with little influence by variations in the pressure of the liquid due to the diaphragm pump. Note that the pressurization chamber 43*c* illustrated in FIG. 15 may accommodate the spring 44 that biases the flexible member 43*a* in a direction in which the liquid storage chamber 43*b* is pressurized.

Figure 16:
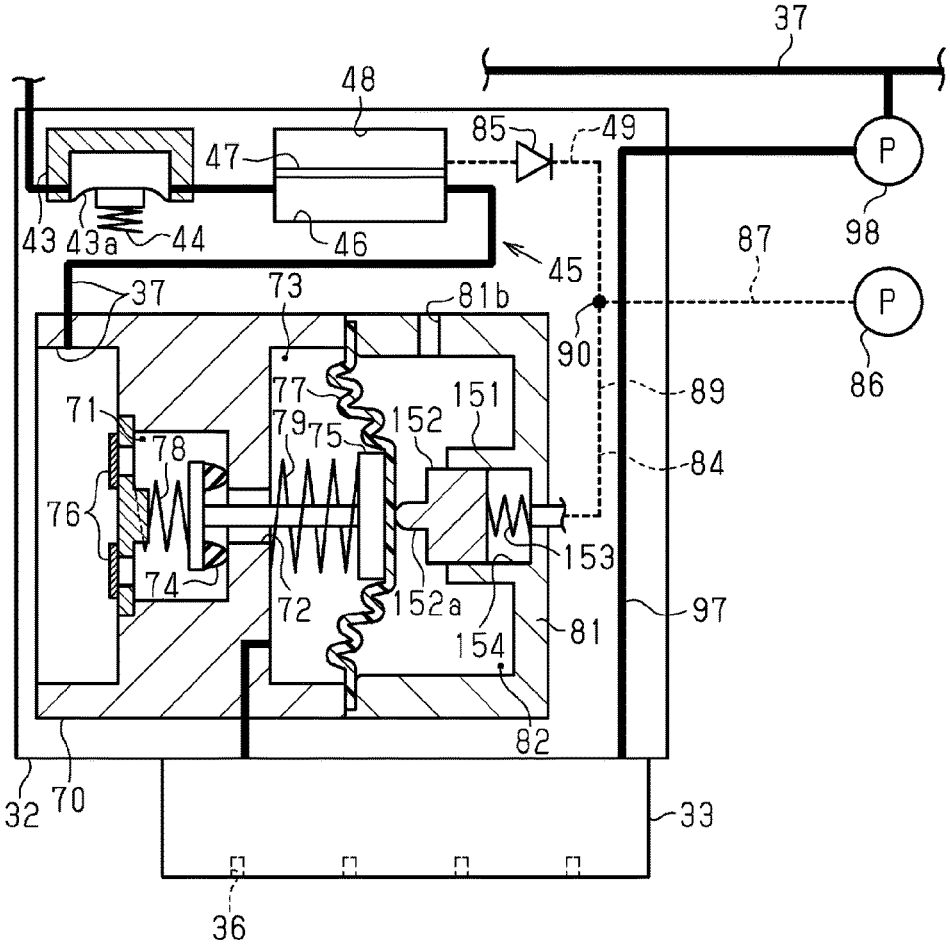
FIG. 16 is a schematic diagram illustrating main parts of another modification example of the pressure regulating mechanism which is different from that in FIG. 15.

The press portion that presses the pressure chamber 73 of the pressure regulating mechanism 70 is not limited to the pressurization bag 83. As illustrated in FIG. 16, a cylinder drive type that includes a cylinder 151 that projects inward toward one surface side of the accommodation chamber 82 which is divided from the pressure chamber 73 by the flexible membrane 77, a piston 152 that is movable in an axial direction thereof in the cylinder 151, and a spring 153 that biases the piston 152 in a direction on the opposite side to a projecting direction (leftward direction in FIG. 16) may be employed. The pressurization channel 84 is connected to a pressurization chamber 154 as an example of the gas containing chamber that is divided into the cylinder 151 and the piston 152. When the pump 86 is pressurized and driven such that the gas is supplied to the pressurization chamber 154 in the cylinder 151 through the one system of the gas channel 87 and the pressurization channel 84, the piston 152 moves along with a projecting portion 152*a* provided on a distal portion of the piston against the bias force of the spring 153 in the projecting direction. The projecting portion 152*a* presses the flexible membrane 77 and the pressure receiving member 75 such that the pressure chamber 73 is pressurized and the pressure regulating mechanism 70 is opened. As a result, the pressurization cleaning is performed by causing the liquid from the nozzles 36 of the liquid ejecting unit 33 to be forcibly discharged. Since the accommodation chamber 82 is opened to the atmosphere through an atmosphere communicating hole 81*b* and the accommodation chamber 82 is held in the atmospheric pressure even during the depressurization drive of the pump 86, the pressure regulating mechanism 70 is opened at a predetermined set pressure. In such a press portion, there is no particular limitation on a drive type such as a pressurization bag type or the cylinder drive type, and press drive by supplying the gas to the pressurization chamber may be employed.

The pressurization chamber is not limited to a chamber for a press portion, and may be a chamber in a pneumatic actuator such as an gas cylinder (single-acting type cylinder) or an gas motor which is driven to act on the liquid in the liquid supply channel. In this case, the gas is supplied from the pump 86, and thereby the pneumatic cylinder is driven. Further, in place of the static mixer 42, and a pressurization drive type agitator may be provided. The agitator includes a pressurization chamber and, for example, gas is supplied to perform pressurization of a pressurization chamber. Airflow (for example, air current) blows from an air nozzle or the like that communicates with the pressurization chamber such that an impeller is caused to rotate, and thereby the impeller for stirring that is fixed to a rotary shaft of the impeller is caused to rotate in a liquid supply channel into which the rotary shaft of the impeller is inserted such that a liquid (for example, ink) in the liquid supply channel is stirred. Note that a chamber of a reciprocating type pneumatic actuator such as an air cylinder may be the pressure regulating chamber as an example of a gas containing chamber, the pneumatic actuator may be subjected to extension drive by pressurization of the pressure regulating chamber, and the pneumatic actuator may be subjected to contraction drive by depressurization of the pressure regulating chamber. As described above, one gas containing chamber may be pressurized or depressurized.

The embodiment may be applied to pressurization and depressurization of the subtank mounted on a carriage disclosed in JP-A-2009-226626. In this case, a gas containing chamber adjacent to a liquid supply channel provided in the carriage for the pressurization and depressurization of the subtank may be pressurized and depressurized through one system of gas channel connected to a pump. As described above, the gas containing chamber may be one chamber that serves as both of the pressurization chamber and the depressurization chamber. In addition, as in the example, the gas containing chamber adjacent to the liquid supply channel does not need to be a chamber divided from the liquid supply channel, and may be a region adjacent to a region of the liquid supply channel in the same chamber. In this case, a region (region from a liquid surface to the bottom) in a containing chamber in the sub tank, in which a liquid is contained, corresponds to a liquid containing region that configures a part of the liquid supply channel. A region (region above the liquid) out of the liquid containing region, in which a gas is contained, corresponds to a gas containing chamber. In the configuration, one system of gas channel is sufficient to be connected between the carriage and the pump in order to perform the degassing and pressurization cleaning of the liquid in the subtank through the depressurization and pressurization of the gas containing chamber. Therefore, it is possible to configure a more compact pressure regulating mechanism, compared to a configuration disclosed in JP-A-2009-226626 that need to include two respective systems of tubes for depressurization and pressurization.

For example, the gas containing chamber provided at a position adjacent to the liquid supply channel is divided from the liquid supply channel via the gas-liquid separation membrane; however, the membrane may be a film having a gas barrier property to the extent that the depressurization of the gas containing chamber (depressurization chamber) causes gas dissolved in the liquid in the liquid supply channel to permeate to the gas containing chamber side.

Figure 17:
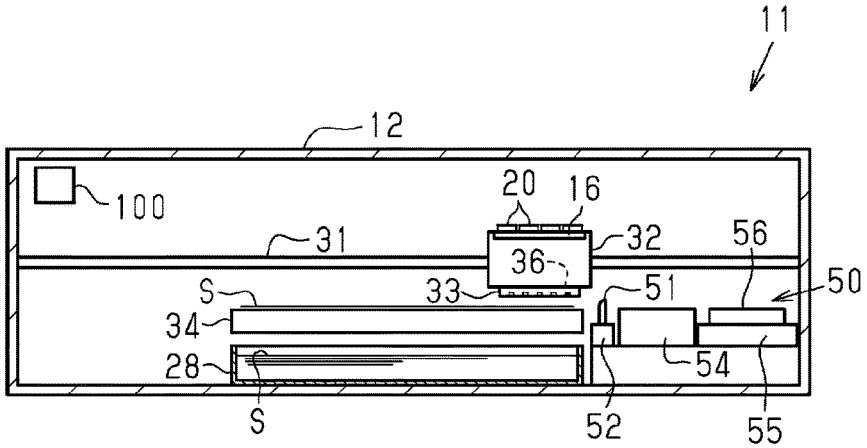
FIG. 17 is a sectional view illustrating a modification example of the liquid ejecting apparatus.

As in a modification example illustrated in FIG. 17, the container holder 16 may be configured not to move. In addition, the container holder 16 may be disposed on the carriage 32.

As in the modification example illustrated in FIG. 17, the liquid ejecting apparatus 11 may include the support leg 13. In addition, in the liquid ejecting apparatus 11, instead of the feeding mechanism 25, the winding mechanism 26, and the tension bar 27, a cassette 28 that contains the medium S which is a sheet of cut paper cut off to have a predetermined size may be detachably attached.

In a modification example of the embodiment, since the pressure in the depressurization chamber of the degassing mechanism 45 needs to be maintained to be the negative pressure in both of during the pressurization drive and during stopping of the pump 86, the one-way valve 85 is provided in the depressurization channel 49; however, the one-way valve 85 may not be provided in a case where the pressure in the depressurization chamber does not need to be maintained to be the negative pressure during the pressurization drive and the stopping of the pump 86.

In a case where the pressure in the pressurization chamber needs to be maintained to be the positive pressure both of during the depressurization drive and during the stopping of the pump 86, the one-way valve may be provided on the pressurization channel 84. In this case, the one-way valve allows gas to flow in a direction in which the pressurization chamber is pressurized and restricts the gas from flowing in a direction in which the pressurization chamber is depressurized.

In place of the tube pump 110, by using a tube pump for both of the pressurization and depressurization having a configuration that is not opened to the atmospheric pressure in the reverse process, the control unit 100 may also have a configuration in which drive control of the tube pump is performed based on detection results of a pressure sensor.

The pump 86 for both of the pressurization and depressurization is not limited to the tube pump, and may be another type of pump. It is possible to use a rotary pump and a diaphragm pump such as a gear pump, a vane pump, or a screw pump, or a reciprocating pump such as a bellows pump, a piston pump, or a plunger pump. In a case of the rotary pump, switching between the forward and reverse of the rotating direction is performed such that switching between sending-out and suction of the gas is performed. In a case of the reciprocating pump, switching control of the valve in which the switching between the sending-out and suction of the gas may be performed.

The configuration is not limited to the configuration in which the liquid supply channel 37 and the gas channel 87 are integrally made of a flexible material. For example, a plurality of liquid supply channels may be integrally formed, and the gas channel may be configured to be a separate member from the liquid supply channel.

The pumping mechanism 38 may send the pressurized gas out to the liquid container 20 (for example, the pressurization chamber formed of a space between the case 22 and the liquid containing portion 21) installed in the container holder 16, and thereby the liquid in the liquid container 20 may be pressurized such that the liquid flows out to the liquid supply channel 37. In this case, as illustrated in FIG. 17, when the container holder 16 is mounted on the carriage 32, the gas may be sent out from the pump 86 through the one system of gas channel to the pressurization chamber in the liquid container 20 installed in the container holder 16, and thereby the liquid may flow out from the liquid container 20 to the liquid supply channel.

The liquid ejecting apparatus 11 may always supply the liquid through the drive of the pumping mechanism 38 without the liquid supply by the water head.

The degassing chamber 46 of the degassing mechanism 45 may be provided on the liquid supply channel 37 that connects the pressure chamber 73 of the pressure regulating mechanism 70 and the filter 96 of the liquid ejecting unit 33.

The liquid ejected by the liquid ejecting unit 33 is not limited to ink and, for example, may be a liquid body in which particles of functional materials are dispersed or mixed in a liquid. For example, a configuration, in which recording is performed by ejecting a liquid body containing, in a way of dispersing or dissolving, a material such as an electrode material or color material (pixel material) which is used in manufacturing or the like of a liquid crystal display, an electroluminescence (EL) display, and a field emission display, may be employed.

The medium S is not limited to a sheet of paper, may be a plastic film, a thin plate material, or the like, or may be cloth used in a textile printing apparatus or the like. In addition, the medium S may be clothes or the like having an arbitrary shape such as a T-shirt, or may be a three-dimensional object having an arbitrary shape such as food or stationery.

The entire disclosure of Japanese Patent Application No. 2016-157660, filed Aug. 10, 2016 and No. 2016-172790, filed Sep. 5, 2016 are expressly incorporated by reference herein.

What is claimed is:

1. A liquid ejecting apparatus comprising:

a liquid ejecting unit that ejects, to a target, a liquid which is supplied from a liquid supply source via a liquid supply channel;

a carriage on which the liquid ejecting unit is mounted and which moves with respect to the target;

a gas containing flow path mounted on the carriage, the gas containing flow path comprising a depressurization chamber and a pressurization chamber;

a pump that is disposed outside the carriage of the liquid ejecting apparatus and communicates with the depressurization chamber and the pressurization chamber through a gas channel, the gas channel extending from the pump and bifurcating into a pressurization channel communicating with the pressurization chamber and a depressurization channel communicating with the depressurization chamber; and a one-way valve disposed in the depressurization channel, the one-way valve allowing gas to flow in a direction such that the depressurization chamber is depressurized and restricting the gas from flowing in a direction such that the depressurization chamber is pressurized, and the pump is configured to switch between delivering gas to the gas channel and suctioning gas from the gas channel.

2. The liquid ejecting apparatus according to claim 1, wherein the gas containing flow path includes the depressurization chamber that is provided at a position adjacent to an upstream portion in the liquid supply channel and is depressurized and the pressurization chamber that presses a downstream portion located between the upstream portion and the liquid ejecting unit in the liquid supply channel and discharges the liquid from the liquid ejecting unit.

3. The liquid ejecting apparatus according to claim 2, wherein a pressing portion that presses the downstream portion of the liquid supply channel of the pressurization chamber is formed by a flexible member.

4. The liquid ejecting apparatus according to claim 1, wherein the liquid supply channel and the gas channel are integrally made of a flexible material.

5. The liquid ejecting apparatus according to claim 1, wherein the pump is a tube pump including a frame that supports a tube having a channel therein, a rotary body that is rotatable around a shaft center by power from a drive source, and a press roller that is supported by the rotary body and rotates around the shaft center so as to press the tube, wherein the rotary body includes a guide portion that extends in the rotating direction of the rotary body and has a blocking position at which the channel of the tube is blocked by the press roller and a canceling position at which blocking of the channel is canceled, wherein the channel is blocked by rotation of the rotary body in one direction, the blocking of the channel is canceled by rotation of the rotary body in the other direction from a state in which the channel is blocked, and then the channel is blocked, and wherein one end of the tube is connected to the gas channel, gas is suctioned from the one end of the tube by the rotation of the rotary body in the one direction, and gas is sent out from the one end of the tube by the rotation of the rotary body in the other direction.

6. The liquid ejecting apparatus according to claim 1, wherein a diameter of the gas channel is smaller than a diameter of the liquid supply channel.

7. The liquid ejecting apparatus according to claim 1, further comprising a plurality of the liquid supply channels, wherein the plurality of the liquid supply channels and the gas channel are integrally made of a flexible material, and the gas channel is sandwiched between groups of the plurality of the liquid supply channels.

* * * * *